US008851000B2

(12) United States Patent
Tempestra

(10) Patent No.: US 8,851,000 B2
(45) Date of Patent: Oct. 7, 2014

(54) CUSTOM EMBROIDERY FRAME

(75) Inventor: Laura Tempestra, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 27 days.

(21) Appl. No.: 13/442,599

(22) Filed: Apr. 9, 2012

(65) Prior Publication Data

US 2013/0263769 A1 Oct. 10, 2013

(51) Int. Cl.
*D05B 39/00* (2006.01)
*D05C 9/04* (2006.01)

(52) U.S. Cl.
USPC ..... 112/475.18; 112/103

(58) Field of Classification Search
CPC ..... D05B 3/04; D05B 39/00; D50C 9/04; D50C 17/00; B44D 3/185; D06F 59/08; D06C 3/08
USPC ..... 112/98–103, 475.17, 475.18; 38/102.2, 38/102.91
See application file for complete search history.

(56) References Cited

U.S. PATENT DOCUMENTS

| | | | | | |
|---|---|---|---|---|---|
| 2,760,299 | A | * | 8/1956 | Gable et al. | 38/102.2 |
| 4,485,574 | A | * | 12/1984 | Bennetot | 38/102.2 |
| 4,561,177 | A | * | 12/1985 | Rancer | 29/721 |
| 4,883,009 | A | * | 11/1989 | Haselberger et al. | 112/475.18 |
| 5,141,140 | A | * | 8/1992 | Moffett-Hall | 223/52 |
| 5,546,877 | A | * | 8/1996 | Moore | 112/103 |
| 5,860,374 | A | * | 1/1999 | Jensen et al. | 112/102.5 |
| 5,860,375 | A | * | 1/1999 | Williams | 112/103 |
| 5,970,895 | A | * | 10/1999 | Mack | 112/103 |
| 6,116,174 | A | * | 9/2000 | Melton | 112/103 |
| 6,263,817 | B1 | | 7/2001 | Tajima | |
| 2007/0277715 | A1 | | 12/2007 | Watanabe | |
| 2012/0017814 | A1 | | 1/2012 | Mack | |

FOREIGN PATENT DOCUMENTS

| | | |
|---|---|---|
| DE | 202006012129 | 11/2006 |
| JP | 03161565 | 7/1991 |

OTHER PUBLICATIONS

International Search Report and Written Opinion of Jul. 12, 2013 for PCT/US2013/035796 filed Apr. 9, 2013.

* cited by examiner

*Primary Examiner* — Ismael Izaguirre
(74) *Attorney, Agent, or Firm* — Shook, Hardy & Bacon L.L.P.

(57) ABSTRACT

Aspects of the present invention relate to systems and methods of utilizing a custom embroidery system. A custom embroidery frame is comprised of a custom receiving cavity sized and shaped to receive a composite piece for embroidery. The size and the shape of the custom receiving cavity correspond with a size and a shape of the portion of the composite piece onto which an embroidery device will embroider. Additionally, a gasket with a size and a shape adapted to be inserted into the receiving cavity and around the portion of the composite piece may optionally be utilized.

28 Claims, 13 Drawing Sheets

CUSTOM EMBROIDERY FRAME

CROSS REFERENCE

This application, is related by subject matter to U.S. application Ser. No. 13/442,537, filed concurrently on Apr. 9, 2012, entitled "ARTICLES OF APPAREL INCORPORATING CUSHIONING ELEMENTS." The entirety of the aforementioned application is incorporated by reference herein.

BACKGROUND

Embroidery processes traditionally rely on maintaining members, such as tensioning hoops, of fixed dimensions to tension a material to be embroidered. Therefore, depending on the size and shape of the embroidery, excess material may be needed to fit within one of the predefined-size maintaining members. Additionally, a number of manufacturing steps may be inserted into an assemble process to accommodate the static maintaining members. For example, because sufficient material to be tensioned is needed by traditional maintaining member, a rough over-sized cut of the to-be-embroidery material may be made at a first facility to accommodate the embroidery maintaining members. The to-be-embroidered material may then be sent to another facility for the embroidery. The embroidered material may then be returned to the cutting facility for pattern sizing and cutting. Therefore, traditional embroidery maintaining members insert inefficiencies into a manufacturing process.

SUMMARY

Embodiments of the present invention relate to systems and methods of utilizing a custom embroidery system. A custom embroidery frame is comprised of a custom receiving cavity sized and shaped to receive a composite piece for embroidery. The size and the shape of the custom receiving cavity correspond with a size and a shape of the portion of the composite piece onto which an embroidery device will embroider. Additionally, a gasket with a size and a shape adapted to be inserted into the receiving cavity and around the portion of the composite piece may optionally be utilized.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
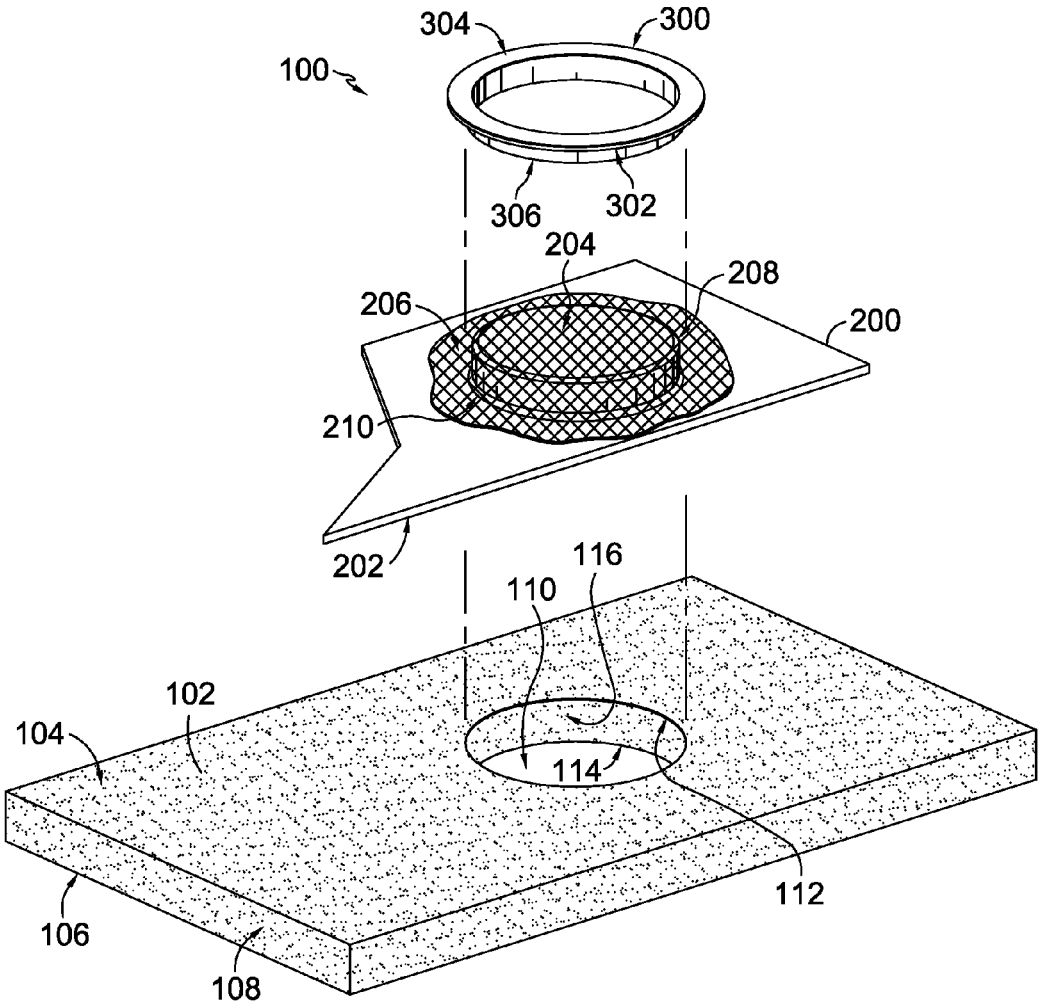
FIG. 1 depicts a custom embroidery system, in accordance with aspects of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Embodiments of the present invention relate to systems and methods of utilizing a custom embroidery system. A custom embroidery frame is comprised of a custom receiving cavity sized and shaped to receive a composite piece for embroidery. The size and the shape of the custom receiving cavity correspond with a size and a shape of the portion of the composite piece onto which an embroidery device will embroider. Additionally, a gasket with a size and a shape adapted to be inserted into the receiving cavity and around the portion of the composite piece may optionally be utilized.

Accordingly, in one aspect, the present invention provides a custom embroidery frame. The custom embroidery frame is comprised of a top surface and an opposite bottom surface. The top surface and bottom surface defining a frame thickness extending from the top surface to the bottom surface. The top surface is positionable in a plane closer to an embroidery head of an embroidery device than the bottom surface. The custom embroidery frame is further comprised of a receiving cavity extending from the top surface to the bottom surface. The receiving cavity is defined by a top perimeter of a shape and a size at the top surface. The top perimeter shape and size substantially corresponding to a shape and a size of a composite piece to be embroidered (e.g., the dimensional material size and shape accounting for a thickness of base material and/or top material proximate the dimensional material sidewall), such that the receiving cavity is functional to receive and maintain the composite piece during an embroidery process.

In another aspect, the present invention provides a method of embroidering using a custom embroidery frame. The method is comprised of forming an embroidery frame with a receiving cavity extending from a top surface of the embroidery frame to a bottom surface of the embroidery frame, such that an internal sidewall extends between the top surface and the bottom surface. A shape and a size of the receiving cavity in a plane of the top surface are defined by a top perimeter. The top perimeter having a shape and a size substantially corresponding to a shape and a size of a composite piece. The method is further comprised of inserting the composite piece in the receiving cavity from the top surface towards the bottom surface. The composite piece is comprised of a first garment portion having an upper surface and a lower surface and a dimensional material having an upper surface, a lower surface, and a side wall extending between the upper surface and the lower surface along a perimeter of the dimensional material. At least a portion of the lower surface of the first garment portion is positioned proximate the internal side wall of the receiving cavity and at least a portion of the upper surface of the first garment portion is positioned proximate the side wall of the dimensional material, such that at least a portion of the first garment portion is positioned between the embroidery frame and the dimensional material. The method is further comprised of embroidering, with an embroidery device, the composite material within the receiving cavity.

A third aspect of the present invention provides an embroidery system. The embroidery system is comprised of a composite material and a custom embroidery frame. The composite material is comprised of a base material portion having a bottom surface and an intermediate surface. The base material portion is shaped in a pattern form for integration into a garment, in this exemplary aspect. The composite is further comprised of a dimensional padded material. The dimensional padded material having an upper surface and an opposite lower surface, an upper edge perimeter and a lower edge perimeter, and a side wall extending between the upper edge perimeter and the lower edge perimeter. The upper edge perimeter defines a shape and a size of the dimensional padded material. Additionally, the composite material is comprised of a top material portion having an intermediate surface and an opposite top surface. The dimensional padded material is positioned between the base material intermediate surface and the top material portion intermediate surface. The base material intermediate surface and the top material portion intermediate surface are coupled together proximate at least a portion of one of the lower edge perimeter or the upper edge perimeter of the dimensional padded material. The custom embroidery frame is comprised of a base material having a top surface and a bottom surface. The custom embroidery frame is further comprised of a receiving cavity extending between the base material top surface and the base material bottom surface. The receiving cavity has a perimeter at the top surface defining a size and a shape in a plane of the top surface of the receiving cavity. The size and the shape of the receiving cavity perimeter substantially corresponds to the upper edge perimeter of the dimensional padded material, such that the receiving cavity is functional for receiving the composite material and maintaining the composite material during an embroidery process.

Having briefly described an overview of embodiments of the present invention, a more detailed description follows.

Traditional embroidery techniques rely on a frame concept in which a member is positioned on the bottom side of a material to be embroidered. The member and material are then inserted, from a bottom side, into a second, slightly larger member. The second member is then tightened to compress the material between the first member and the second member to maintain a level of tension in the material. The tension helps facilitate the embroidery process.

However, the traditional process of two members relies on static-sized and static-shaped members to provide the tension. For example, a ring-like member is commonly used such that the first member is a first diameter and the second member is a slightly larger diameter to facilitate ease of inserting the first member and material combination. Because the members are static-sized and static-shaped, a common member combination may be used for a variety of embroidery processes and resulting products.

Relying on a one-size-fits-all concept when it comes to the traditional tensioning members introduces inefficiencies with respect to the material to be embroidered. For example, the material (or combination of materials) to be embroidered is maintained in an over-sized dimension to be effectively maintained in the one-size-fits-all members. Consequently, following the embroidery processes, the embroidered material is then cut to a pattern size for integration into a garment. This subsequent cutting may involve sending the embroidered material back to a cutting facility that is different from the embroidery facility. This subsequent cutting step may introduce delay and other additional expenses, such as excess material scrapping, into the manufacturing process.

Inefficiencies in the manufacturing process increase with size of a portion to be embroidered as well as with irregularity of shapes of material/dimensional portions to be maintained by the members. For example, when a dimensional material (to be discussed hereinafter) is intended to be embroidered, the dimensional material may have a size or shape that does not efficiently utilize an internal space provided by a maintaining member, such as an embroidery hoop. Therefore, a custom embroidery frame having a shape and a size corresponding to a shape and size of a material to be embroidered may be beneficial in increasing manufacturing efficiencies.

Additional efficiencies that may be gained with a custom embroidery frame may include a greater utilization of multiple embroidery heads on an embroidery device. For example, if a traditional maintaining member is utilized that is over-sized relative to an area to be embroidered is relied on, the maintaining member may interfere with a useable area of a neighboring embroidery head. When there is interference, the neighboring embroidery head may remain idle, which is an inefficient use of resources. A custom embroidery frame may allow for the efficient placement of the to-be-embroidered material on the embroidery device.

Further, as will be discussed in greater detail hereinafter, manufacturing steps and materials may be reduced or eliminated as a result of a custom embroidery frame. For example, a custom embroidery frame is contemplated to allow for a reduction in material waste, a reduction in stitching operations, a reduction in loading times, a reduction in alignment processes relative to an embroidery head, a reduction in embroidery materials, such as a backing referred to as solvy, and other efficiencies contemplated and explored hereinafter.

The custom embroidery frame is customized for the material to be embroidered. Therefore, as opposed to relying on a limited set of maintaining member options to fill all needs, a custom embroidery frame is formed for a particular operation. The frame is contemplated as being constructed from a variety of materials, such as a polymer-based material (e.g., nylon, polyethylene, polystyrene, polyvinyl chloride), a foam-based material, a metallic material, a ceramic material, and/or an organic material (e.g., wood).

The forming of a custom frame is contemplated as being performed by an additive process, such as laser sintering or other rapid manufacturing techniques where materials are added together to form a resulting embroidery frame. Additionally, it is contemplated that a subtractive process is implemented to form the embroidery frame. The subtractive process may include removing a portion of material from a known quantity of material to result in an embroidery frame. Techniques for forming a subtractive process include milling, etching, carving, and the like. For example, it is contemplated that a computer-numerically-controlled (CNC) milling machine is provided with a three-dimensional file defining a receiving chamber (to be discussed hereinafter) to be cut from a block of foam. The CNC milling machine mills out the receiving chamber from the foam material such that the remaining foam block includes a void that serves as a receiving chamber for an embroidery process. Another forming technique contemplated includes a CNC laser effective for cutting out a desired receiving cavity shape. Other techniques are contemplated for forming the embroidery frame, as will be discussed hereinafter.

The custom embroidery frame is effective to align a composite material with the embroidery device. The custom embroidery frame may also be effective for providing a level of tension to one or more portions of the composite material to facilitate embroidering the composite material. Further, the custom embroidery frame may be effective for aligning a first portion of the composite material with a second portion of the composite material, in preparation for embroidering the composite material. Additional advantages are contemplated and will be discussed hereinafter.

The composite material to be embroidered may be comprised of two or more layers of material. In an exemplary aspect, the composite material is comprised of a base material, a dimensional material, and a top material. For example, the base material may be a material used in the construction of a garment, such as pants, shirts, shorts, socks, underwear, and protective articles (e.g., shin guards, elbow pads, neck supports, helmets, head gear, and the like). The base layer may be an organic or a synthetic material, such as a polyester/elastane fabric mix. In an exemplary aspect, the base material is pattern cut prior to being introduced to the custom embroidery frame and the embroidery device. A pattern cut contemplates the base material having a size and shape such that once the embroidery is completed (or prior to), the base material may be incorporated into the construction of a garment without additional trimming/sizing. It is contemplated that following the construction of the article that additional post-processing procedures, such as trimming, may be performed to the garment as a whole (or the base layer in particular).

The base layer may be formed from a material having an elastic characteristic. For example, a material that when deformed exhibits a behavior to return to a pre-deformed size and shape. Stretchable materials may be used as a base material.

The composite material may also be comprised of a dimensional material. The dimensional material may be a material, such as a pad, that has a defined size and shape when in a relaxed state. For example, even though a protective pad formed from a foam-like material may deform permanently or temporarily when an impact force is applied, the protective pad has a relatively consistent size and shape under ambient forces. The size and shape, in addition to thicknesses of other materials in the composite material, may determine a size and a shape of a receiving cavity in a custom embroidery frame. Exemplary materials that may be utilized as dimensional materials include, but are not limited to: polyethylene (PE), ethylene vinyl acetate (EVA), styrene, butylene, and any combination thereof. For example, it is contemplated that a PE/EVA combination may be utilized for a dimensional material portion. Further, it is contemplated that a styrene, ethylene, butylenes, and styrene layered combination may also and/or alternatively be utilized for at least a portion of the dimensional material.

The composite material may also be comprised of one or more additional materials, such as a top layer. The top layer may be effective for maintaining the dimensional material in a desired location relative to the underlying base material. For example, it is contemplated that the top layer may be formed from a mesh-like material that provides a plurality of voids for aesthetic purposes, ventilation purposes, and as a reduction in mass. As will be discussed hereinafter, it is contemplated that the top layer is sewn (or otherwise coupled) with the base layer along a perimeter of the dimensional material as the dimensional material is sandwiched between the base material and the top material, in an exemplary aspect. In an exemplary aspect, the top material may be a polyester and/or a polyester/elastane warp knit mesh or a circular knit mesh, for example.

The custom embroidery frame may also be comprised of a gasket, in an exemplary aspect. The gasket may be custom formed with a size and a shape that is functional for being inserted into a receiving cavity of the custom embroidery frame to compress a portion of the composite material, such as the base layer, against a sidewall or top surface of the custom embroidery frame. The compression provided by the gasket may facilitate maintaining the composite material in a desired position within the custom embroidery frame during an embroidery process.

FIG. 1 depicts a custom embroidery system 100, in accordance with aspects of the present invention. Initially, a custom embroidery frame (also referred to herein as a frame) 102 is illustrated. The frame 102 has a top surface 104 and an opposite bottom surface 106. A thickness 108 extends between the top surface 104 and the bottom surface 106. While a rectangular shape is depicted as being formed by the frame 102, it is contemplated that the frame may be any size and shape that facilitates realizing the benefits provided herein. For example, it is contemplated that the frame may have a shape that is conducive for securing to an embroidery device (e.g., tabs or insets at defined locations for aligning the frame to the embroidery device). Additionally, it is contemplated that the frame 102 may have a shape that corresponds to a receiving cavity 110, such that an offset distance extends away from the receiving cavity 110. Additional sizes and shapes are contemplated herein.

The thickness 108 may be any thickness; however, in an exemplary aspect, it is contemplate that the thickness 108 is a thickness that allows a top surface of a composite piece 200 to be relatively flush or slightly recessed from the top surface 104 to facilitate movement of an embroidery head. However, it is also contemplated that the thickness 108 is a thickness greater than a thickness of the composite piece 200, in an exemplary aspect.

As previously discussed, the frame 102 may be formed from any material, such as foam, resin, metal, plastic, and/or the like. In an exemplary aspect, it is contemplated that a sheet-like material that is easily milled by a CNC mill may be the foundation from which a frame is formed. For example, a foam-like material that is resilient, relatively inexpensive, and easily processed may be utilized. The resiliency of the material may aid in providing a frame structure capable of deforming to receive the composite piece 200 as the composite piece 200 is inserted into a receiving cavity 110. Subsequent to the insertion of the composite piece 200 into the receiving cavity 110, the resiliency of the material may allow the receiving cavity to compress the composite piece 200 as the receiving cavity attempts to return back to a pre-deformed size and shape.

The shape of the receiving cavity 110 may be defined by a top perimeter 112 and/or a bottom perimeter 114. The top perimeter 112 is an edge where the top surface 104 of the frame 102 begins forming a chamber in which a portion of the composite piece 200 may be maintained. Extending between the top perimeter 112 and the bottom perimeter 114 is an internal sidewall 116. The internal sidewall 116 is a surface forming the wall within the receiving cavity, such that it is contemplated that a portion of the composite piece 200 may contact the internal sidewall 116 when in an in-use position.

The bottom perimeter 114 may have a size and shape of the top perimeter 112, in an exemplary aspect. However, it is also contemplated that the bottom perimeter 114 may be slightly larger, smaller, or of a different shape to accommodate one or more portions of the composite piece 200. For example, the bottom perimeter 114 may be slightly larger than the top perimeter 112 such that when the composite piece is inserted into the receiving cavity 110, the composite piece 200 is naturally drawn downwardly by a resulting angle to the internal sidewall 116. This downward pressure may be effective for countering an upward force provided by an embroidery head/device during an embroidery process. Additional size and shape discrepancies between the top perimeter 112 and the bottom perimeter 114 are contemplated.

The size and the shape of the receiving cavity 110 may be based on a size and a shape of the composite piece 200. For example, in order to maintain the composite piece 200 in a desired position during an embroidery process, a compressive fit between the receiving cavity 110 and the composite piece 200 may be utilized. Therefore, in aspects of the present invention, the size and the shape of the receiving cavity 110 is derived from the size and the shape of a portion of the composite piece 200.

The composite piece 200 is comprised of a base material 202, a dimensional material 204, and a top material 206. The base material, as previously discussed may be of any size, shape, and material. For example, it is contemplated, as previously discussed, that the base material may be patterned cut prior to being embroidered. Having the base material 202 cut to a size and shape that is useable for forming a finished good, such as a shirt or a pant, allows for the efficient use of the base material. For example, if a traditional over-sized maintaining member is used for embroidery, the base material would be of a sufficient size to be maintained by the traditional over-sized maintaining member, which may prevent the base material from being cut to a desired size and shape prior to being embroidered. Continuing with this example, if the base material is intended to be a long and narrow portion, a traditional maintaining member for embroidery may be a hoop-like device having a diameter of at least the length of the base material. In this example, the base material may not be pattern cut prior to being embroidered because the desired narrow width is not sufficient to be engaged in the traditional over-sized maintaining member that can accommodate the length of the base material.

The base material 202 has an irregular shape in FIG. 1. The irregular shape reinforces that the shape of the base material is independent of the shape of the receiving cavity 110, in an exemplary aspect.

The shape of the dimensional material 204, in an exemplary aspect, does dictate the shape of the receiving cavity 110. For example, as illustrated in FIG. 1, the dimensional material 204 is a disc-like shaped object. The receiving cavity 110 is therefore shaped in a disc-like manner to accommodate the composite piece 200 comprised of the dimensional material 204. Further, the receiving cavity 110 is also sized in a manner to accommodate, but yet maintain, the composite piece 200 that is comprised of the dimensional material 204. Therefore, the receiving cavity 110 has a shape and a size corresponding to the dimensional material 204 as maintained in the composite piece 200 (e.g., accounting for the thickness of the top material 206 and the base material 202).

It is contemplated that the size of the receiving cavity 110 is within five percent of the size of the dimensional material 204 as maintained in the composite piece 200. In another exemplary aspect, it is contemplated that the size of the receiving cavity 110 is within one percent of the size of the dimensional material 204 as maintained in the composite piece 200. As a result, it is contemplated that the receiving cavity is zero to five percent greater the size of the composite piece to be received, in an exemplary aspect. However, additional tolerances are contemplated greater and smaller depending on the material from which the composite piece 200 is constructed and the material from which the custom embroidery frame 102 is constructed. The compressibility, elasticity, and other deformability characteristics of the material affects a level of tolerance that is useable while still maintaining the composite piece in a desired position and location during an embroidery process. In an exemplary aspect, when an optional gasket is utilized in combination with the custom embroidery frame, the receiving cavity may have a size that is greater than that of the composite piece to allow for the insertion of the gasket. Further, it is contemplated that in an exemplary aspect that when the optional gasket is not utilized, the receiving cavity and the composite piece are of a closer size to one another than when a gasket is utilized. Therefore, a receiving cavity is sized, in an exemplary aspect, based on if an optional gasket is intended to be utilized.

The dimensional material 204 has a top perimeter 208 and a bottom perimeter 210. The shape of the dimensional material 204 may be described, in an exemplary aspect based on one or more of the top perimeter 208 and/or the bottom perimeter 210. The dimensional material 204 may also have a thickness that extends between a plane in which the top perimeter 208 extends and a plane in which the bottom perimeter 210 extends.

The top material 206 is a material forming a portion of the composite piece 200. As previously discussed, it is contemplated that the top material 206 forms an first boundary and the base material 202 forms a second boundary between which the dimensional material 204 is positioned. Therefore, when an embroidery process is performed on a top surface of the dimensional material 204, the top material 206, the dimensional material 204, and the base material 202 are coupled together by way of an embroidery stitch.

As previously discussed, the top material 206 may be formed from any material, such as a mesh-like material. For example, a durable mesh that is abrasion resistant, breathable, and provides sufficient voids to perceive the underlying dimensional material 204 are contemplated. However, other flexible materials may be implemented.

A size and a shape of the top material 206 may be adjusted depending on a desired final product. For example, it is contemplated that the top material 206 is sized and shaped to cover the dimensional material 204 and a thickness of the dimensional material 204. Therefore, as depicted in FIG. 1, the top material 206 is of sufficient size and an appropriate shape to cover the dimensional material 204 such that the top material 206 may be coupled with the base material 202 proximate the bottom perimeter 210. Additional sizes and shapes are contemplated as will be discussed herein.

The term "proximate," as used herein, contemplates at, on, or near a component, position, identifier, and/or the like. For example, something that is positioned proximate a component may be on the component, at the component, abutting the component, contacting the component, within a defined distance of the component, or the like. In an exemplary aspect, a perimeter stitch is discussed herein as being proximate a lower perimeter of a dimensional material. However, in aspects of the present invention, the perimeter stitch does not pass through (couple) the dimensional material, but instead is a stitch surrounding the dimensional material. Therefore, the perimeter stitch may be within several millimeters (e.g., 5 millimeters) of the dimensional material, in an exemplary aspect.

A gasket 300 comprised of an insertion flange 302 and a top lip 304 is also depicted in FIG. 1. The gasket 300 is contemplated as an optional portion of the custom embroidery system 100, in an exemplary aspect. However, the gasket 300 is also contemplated as an integral component of the embroidery system 100 in alternative exemplary aspects. As will be depicted in FIG. 2 hereinafter, the gasket 300 is contemplated as being inserted around the dimensional material portion 204 of the composite piece 200 but inside of the receiving cavity 110. In particular, the insertion flange 302 may be inserted over the composite piece 200 in the receiving cavity 110 to provide a compressive force between at least a portion of the base material 202 and the internal sidewall 116.

The gasket 300 has a size and a shape corresponding to the dimensional material 204 as incorporated into the composite piece 200, which contemplates accounting for thickness of additional materials (e.g., the base material 202, the top material 206). For example, the insertion flange 302 has a shape and size that may be defined by a flange perimeter 306. The flange perimeter 306 is of a sufficient size such that the dimensional material 204 is able to fit within an internal volume of the insertion flange while an exterior surface of the insertion flange is able to be inserted into the receiving cavity 110 along the internal sidewall 116. A tolerance of the size and shape of the insertion flange 302 is affected by the materials from which the custom embroidery frame 102, the composite piece 200, and the gasket 300 are formed.

The gasket 300 is also comprised of a top lip 304. The top lip is functional for applying a compressive force on the composite piece 200 along the top surface 104. For example, as will be seen in FIG. 2 hereinafter, the composite piece 200 extends along a portion of the top surface 104 beyond the top perimeter 112. A bottom surface of the top lip 304 may contact a portion of the composite piece 200 to apply a force into the top surface 104 to further aid in maintaining the composite piece 200 in a desired location during an embroidery process.

The gasket 300 may be formed from any suitable material, such as polymer-based, metallic, organic, and/or foam-like materials. For example, it is contemplated that an additive rapid manufacturing technique may be implemented to produce a gasket 300 having a size and shape suitable for an intended purpose. Additionally, it is contemplated that a subtractive process may be implemented to form the gasket 300 (e.g., CNC milling). Other manufacturing processes are also contemplated.

Figure 2:
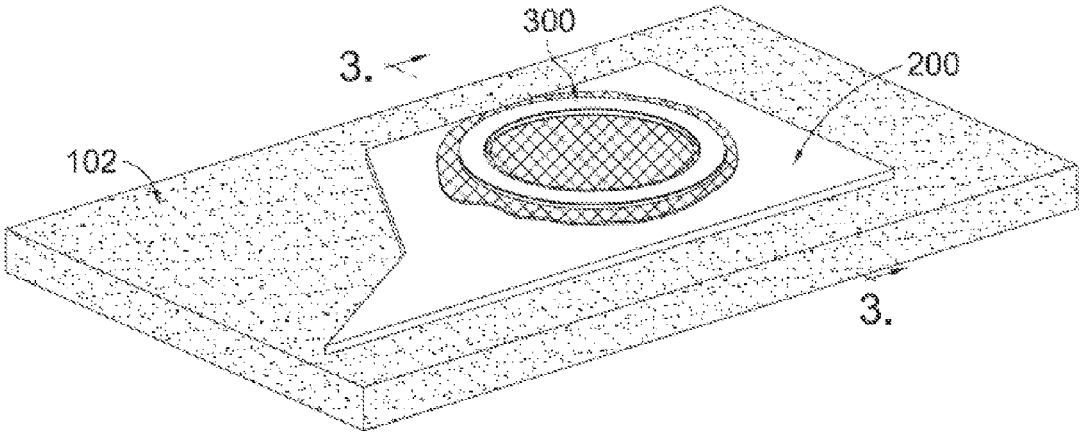
FIG. 2 depicts an assembled custom embroidery system, such as that discussed with respect to FIG. 1, in accordance with aspects of the present invention.

FIG. 2 depicts an assembled custom embroidery system, such as that which was discussed with respect to FIG. 1, in accordance with aspects of the present invention. As previously discussed, the custom embroidery frame 102 is depicted with the composite piece 200 inserted into the receiving cavity. Portions of the composite piece 200 extend out of the receiving cavity and onto the top surface of the frame 102 (e.g., the base material and the top material). Further, in this exemplary aspect, the gasket 300 is positioned over the composite piece 200 and into the receiving cavity. The insertion flange previously discussed with respect to FIG. 1 is wedged between the internal side wall of the receiving cavity and the dimensional material of the composite piece 200, with portions of the composite piece also being compressed (e.g., the base material and the top material).

As will be discussed hereinafter, it is contemplated that the top layer of the composite piece 200 is trimmed to the bottom perimeter of the dimensional material (or any other desired location). Therefore, while the top material that is mesh-like in appearance is depicted as extending beyond the gasket 300, alternative embodiments contemplate the top material terminating at a point of coupling with the base material near the bottom perimeter of the dimensional material, as will be discussed hereinafter.

FIG. 2 also depicts a cutline 3-3 extending across the frame 102, the composite piece 200, and the gasket 300, which provides a perspective for FIG. 3 hereinafter.

Figure 3:
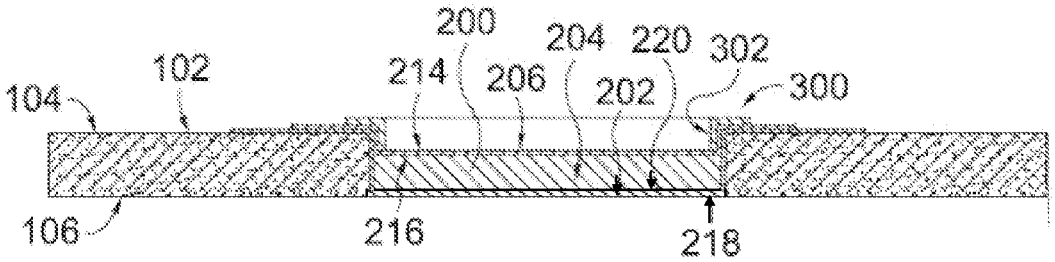
FIG. 3 depicts a cross-sectional view along the cutline 3-3 of FIG. 2, in accordance with aspects of the present invention.

FIG. 3 depicts a cross-sectional view along the cutline 3-3 of FIG. 2, in accordance with aspects of the present invention. The frame 102 having the top surface 104 and the bottom surface 106 is illustrated. The composite piece 200 having the base material 202, the dimensional material 204, and the top material 206 is also illustrated. Further, the gasket 300 having the insertion flange 302 is also illustrated.

The top material 206 is comprised of a top surface 214 and an intermediate surface 216. The top surface may form an exterior portion (or an interior portion) of a resulting garment. The intermediate surface 216 is in contact with a top surface of the dimensional material 204, when positioned proximate the dimensional material 204. Alternatively, it is contemplated that the intermediate surface 216 is coupled with an intermediate surface 220 of the base material 202 at other locations (e.g., near a bottom perimeter of the dimensional material 204). Additionally, it is contemplated that the base material 202 is comprised of a bottom surface 218. The bottom surface 218 may form a skin-contacting surface, a liner contacting surface, or another exterior (or interior) surface of a finished garment.

In this illustrated aspect, a distal end of the insertion flange 302 compresses down on the top surface 214 of the top material 206 proximate a top perimeter of the dimensional material 204. Additionally, side walls of the insertion flange 302 compress one or more portions of the composite piece 200 against at least a portion of the sidewall of the receiving cavity. As will be illustrated in FIGS. 17 and 18 hereinafter, it is also contemplated that one or more portions of the gasket 300 may extend between the dimensional material (as potentially covered by the top material 206) and the internal sidewalls of the receiving cavity (as potentially covered by the base material 202), in accordance with exemplary aspect of the present invention.

As is illustrated in FIG. 3, the composite material is inserted into the receiving cavity of the frame 102 in a manner that may cause tension to be experienced by the base material 202 as friction from internal sidewalls of the receiving cavity and side walls of the dimensional material interact. It is therefore contemplated that the interaction between the frame 102 and a portion of the composite piece 200 facilitates allowing the composite piece 200 to be embroidered without relying on a third mechanism, in an exemplary aspect. Further, as depicted, it is contemplated that a bottom surface of the base material 202 may extend down to a plane of the bottom surface 106 of the frame 102. Stated differently, the composite piece 200 extends down to a useable surface of the embroidery machine onto which the frame 102 is positioned. This is further illustrated hereinafter with respect to FIGS. 17 and 18 also depicting a respective composite piece extending down to a plane in which a bottom surface of a respective frame is positioned.

Figure 4:
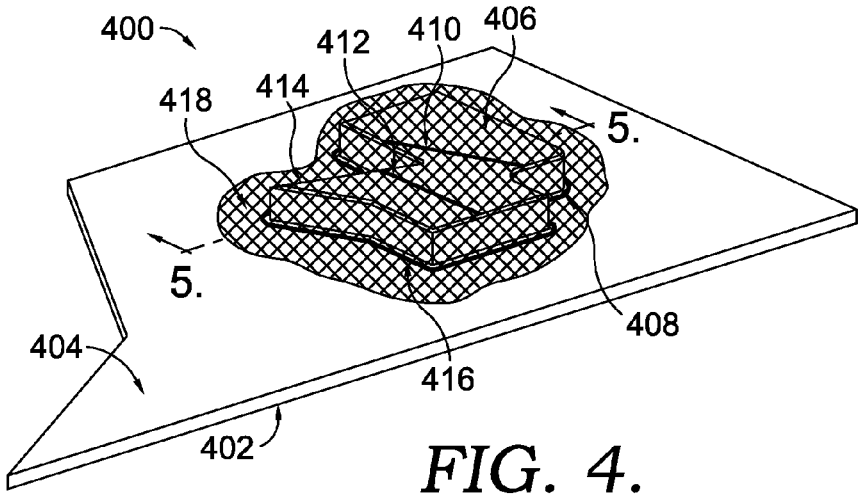
FIG. 4 depicts another exemplary composite piece with perimeter stitching and embroidery, in accordance with aspects of the present invention.

FIG. 4 depicts another exemplary composite piece 400 with perimeter stitching 408 and embroidery 410 and 412, in accordance with aspects of the present invention. The composite piece 400 is comprised of a base material 402, a dimensional material 406, and a top material 418. The base material has an intermediate surface 404 on which the dimensional material 406 is positioned. The dimensional material has a bottom perimeter 416 and a top perimeter 414.

The top material 418 is coupled with the base material 402 proximate the bottom perimeter 416 with the perimeter stitching 408. The perimeter stitching 408 forms a pocket in which the dimensional material 406 is secured. Therefore, it is contemplated that the dimensional material 406 is maintained in a desired position relative to the base material 402 as a result of the formed pocket between the top material 418 and the base material 402. Consequently, it is contemplated that the dimensional material 406 may therefore not need adhesives or other maintaining concepts to keep the dimensional material in a desired position during an embroidery process. However, it is also contemplated that additional maintaining concepts may be implemented in the alternative or in addition.

As will be discussed in greater detail with respect to FIG. 15 hereinafter, it is contemplated that the portion of the top material 418 that extends beyond the perimeter stitching 408 may be removed, such as by cutting or trimming.

Embroidery 410 and 412 are embroidery stitching extending through the composite piece 400. An embroidery machine in combination with a custom embroidery frame having a receiving cavity sized and shaped to maintain the dimensional material 406 as incorporated into the composite piece 400 is contemplated to incorporate the embroidery stitching. The embroidery stitching 408 and 410 may provide functional characteristics such as enhancing the durability of the composite piece when integrated into a garment, affecting where and how the composite piece 400 flexes, and an amount of elasticity provided by the composite piece 200, for example. Additionally, it is contemplated that the embroidery 408 and 410 may also provide aesthetic embellishments to the composite piece 400. Additional benefits of embroidering the composite piece 400 are contemplated, such as securing the dimensional material 406 to the base material 402 (and the top material 418).

FIG. 4 also illustrates a cutline 5-5 extending across a portion of the composite piece 200, as will be discussed in the following FIG. 5.

Figure 5:
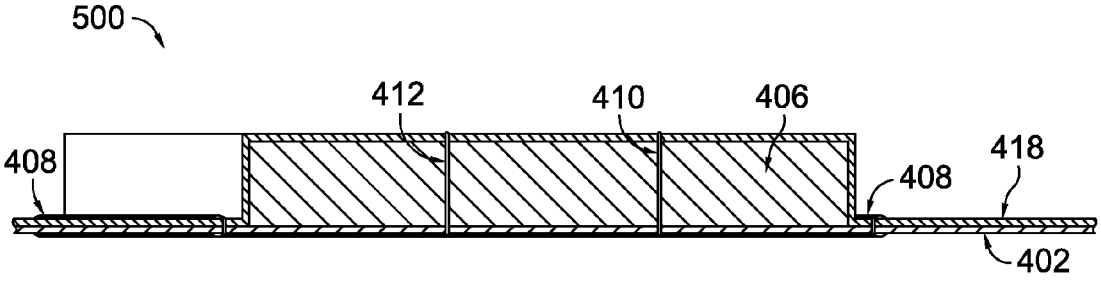
FIG. 5 depicts a cross-sectional view along cutline 5-5 of a portion of the composite piece discussed with respect to FIG. 4, in accordance with aspects of the present invention.

FIG. 5 depicts a cross-sectional view 500 along cutline 5-5 of a portion of the composite piece 400 discussed with respect to FIG. 4, in accordance with aspects of the present invention. The top material 418 and the base material 402 form a pocket maintaining the dimensional material 406. The pocket is formed by the perimeter stitching 408 extending along a bottom perimeter of the dimensional material 406, as previously discussed. As illustrated, the embroidery 410 and 412 extends through the top material 418, the dimensional material 406, and the base material 402. However, as previously discussed, it is contemplated that one or more additional/fewer portions of material may be integrated into the composite piece. Therefore, in those alternative aspects, one or more additional/fewer portions of material may be included with the embroidery 410 and 412. It is contemplated that the embroidery 410 and 412 may form any pattern, shape, size, position, and type within/on the composite piece.

Figure 6:
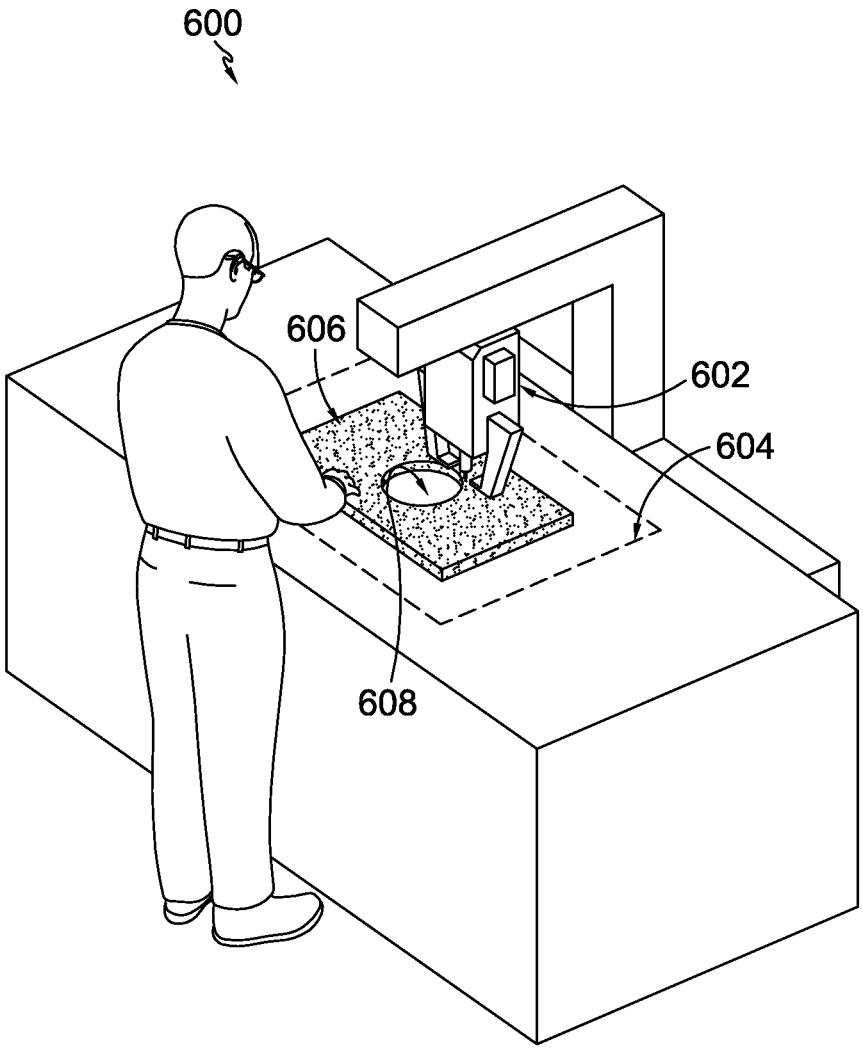
FIG. 6 depicts an exemplary embroidery system utilizing a custom embroidery frame, in accordance with aspects of the present invention.

FIG. 6 depicts an exemplary embroidery system utilizing a custom embroidery frame 606, in accordance with aspects of the present invention. An embroidery head 602 is depicted having a useable space 604 in which embroidery may be performed. While only a single embroidery head is depicted in FIG. 6 for purposes of illustration, it is contemplated that multiple embroidery heads may be aligned in a common embroidery device. When multiple embroidery heads are part of a common embroidery device, traditional over-sized embroidery maintainers (and/or a resulting embroidery pattern) may encroach on a neighboring embroidery head's useable space. As a result, one or more embroidery heads in a multiple embroidery head scenario may not be utilized because the useable space for the head is obscured, at last in part, by the traditional embroidery maintainer. Advantageously, a custom embroidery frame may be formed so that the frame does not encroach on a neighboring useable space. Additionally, the custom frame may be aligned in a manner on the embroidery device to avoid interfering with a neighboring useable space. Therefore, implementation of a custom embroidery frame may provide a number of efficiencies in the manufacturing process by utilizing a greater amount of available resources.

The useable space 604 is a space in which the embroidery head 602 is able to embroider. Consequently, a portion of a composite piece to be embroidered is positioned in the useable space 604. Stated differently, a receiving cavity 608 of the frame 606 is positioned within the useable space 604 such that the embroidery head 602 may perform an embroidery operation on at least a portion of the composite piece. Not depicted, but contemplated, is a computing system for controlling the embroidery device and the embroidery head 602, as is well known in the art and therefore not discussed in greater detail herein.

Figure 7:
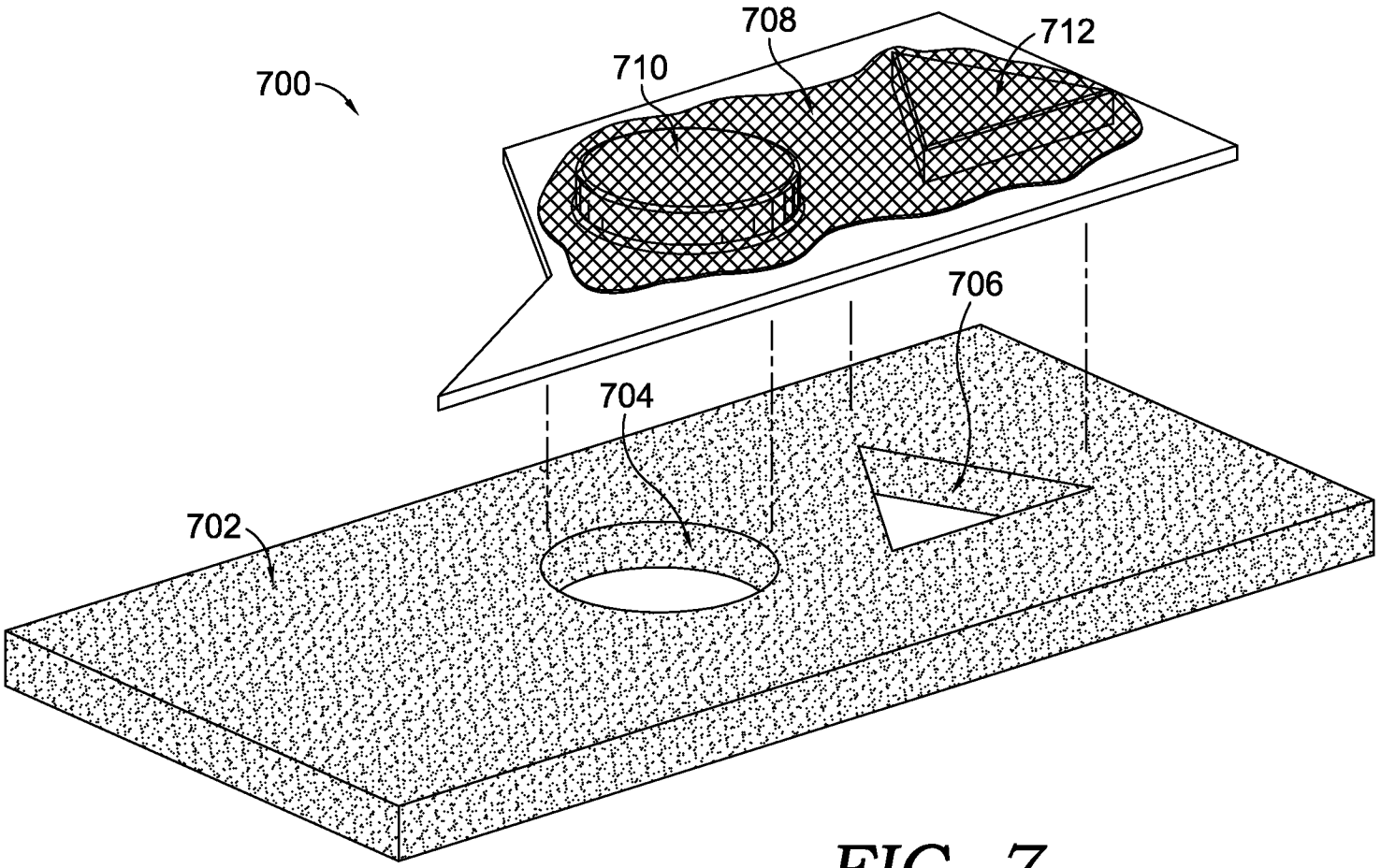
FIG. 7 depicts an exemplary embroidery system functional to embroider at least two discrete dimensional material portions, in accordance with aspects of the present invention.

FIG. 7 depicts an exemplary embroidery system 700 functional to embroider at least two discrete dimensional material portions of a common article, in accordance with aspects of the present invention. A frame 702 is comprised of a first receiving cavity 704 and a second, discrete, receiving cavity 706. Each of the receiving cavities 704 and 706 are custom formed to have a shape and a size that corresponds with a portion of a composite piece 708 to be received. As previously discussed, a receiving cavity has a shape and a size corresponding to a portion to be received when the portion to be received closely fit within the receiving cavity. For example, much like two puzzle pieces are known to fit together when a protruding portion of a first puzzle piece corresponds with a receiving portion of a second puzzle piece. In this illustrated example, a first dimensional material 710 (and material portions of the composite piece 708) corresponds to the receiving cavity 704. Similarly, a second dimensional material 712 corresponds with the receiving cavity 706. It is contemplated hat when a plurality of discrete dimensional portions (e.g., discrete pad portions) are intended to be incorporated into a common pattern pieces, a custom embroidery frame may have a plurality of receiving cavities to accommodate the plurality of dimensional materials.

Having multiple receiving cavities in a common frame may facilitate embroidering multiple composite pieces in single embroidery process, embroidering multiple portions of a common composite piece (as depicted) in a single embroidery process, and/or allow for multi-part garments to be embroidered in a common embroidery process.

Figure 8:
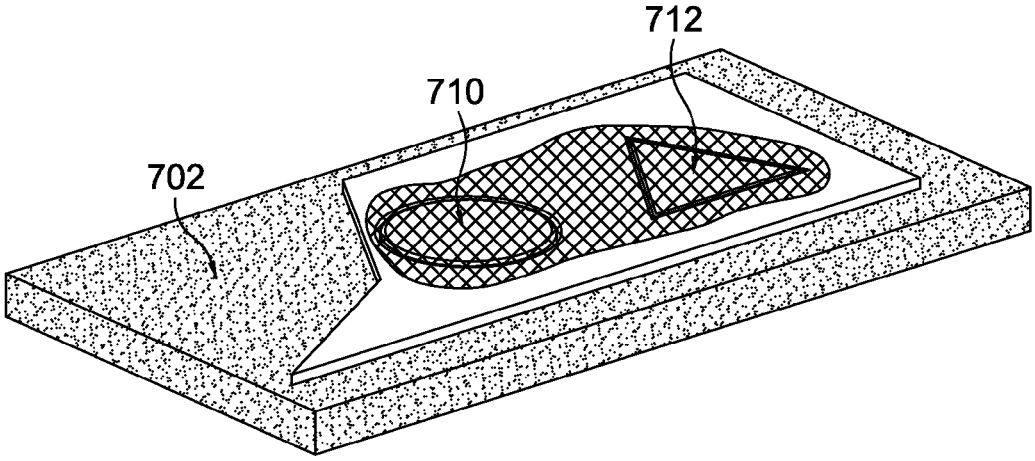
FIG. 8 depicts a frame with two dimensional materials inserted in to their respective receiving cavities within the frame, in accordance with aspect of the present invention.

FIG. 8 depicts the frame 702 with the dimensional materials 710 and 712 inserted in to their respective receiving cavities within the frame 702, in accordance with aspect of the present invention. It is contemplated that an embroidery process may be applied to one or more portions of the composite piece while it is inserted into the frame 702.

Figure 9:
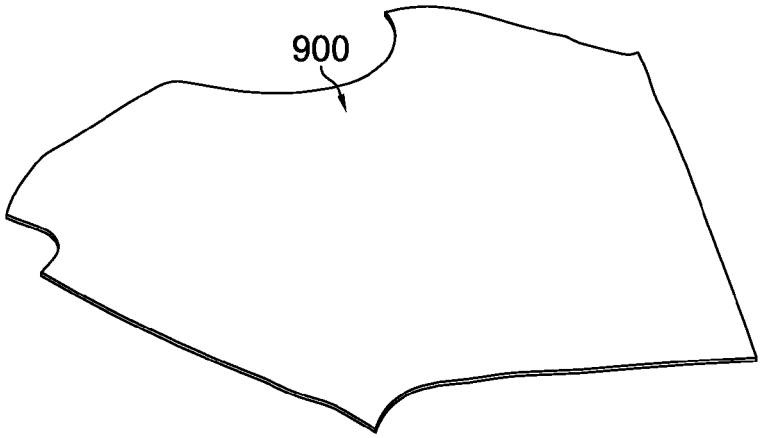
FIG. 9 depicts an exemplary base material, in accordance with aspects of the present invention.

FIG. 9 depicts an exemplary base material 900, in accordance with aspects of the present invention. The base material 900 is cut to a defined shape and size for integration into a garment, which is also referred to herein as pattern cut. Therefore, the size and shape of the base material is dictated by the ultimate garment into which it will be assembled, not by the shape and size of an embroidery maintainer used to facilitate embroidering the base material.

Figure 10:
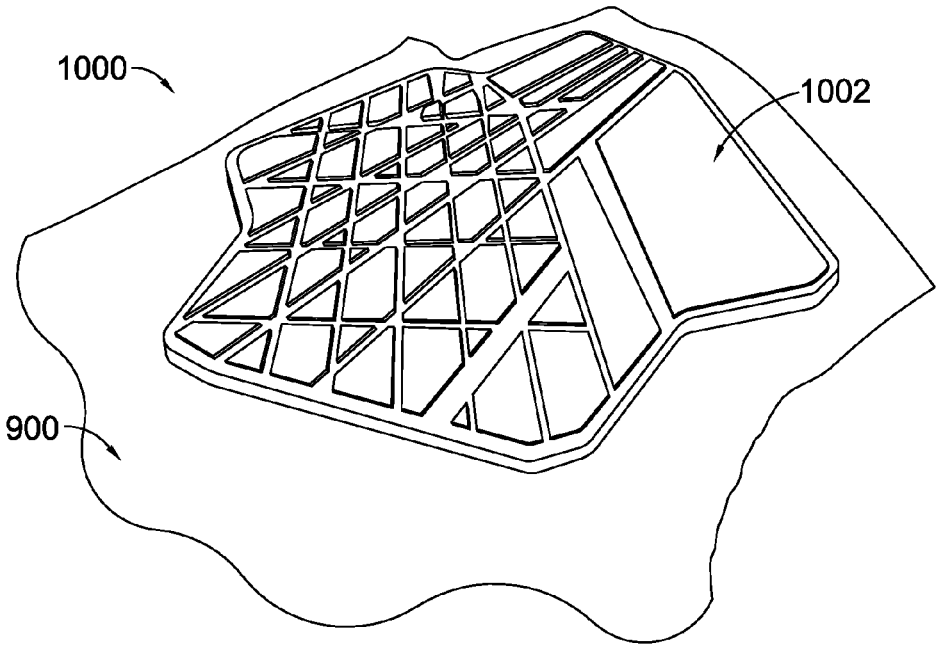
FIG. 10 depicts an exemplary combination of a base material and a dimensional material, in accordance with aspects of the present invention.

FIG. 10 depicts an exemplary combination 1000 of the base material 900 and a dimensional material 1002, in accordance with aspects of the present invention. In this example, the dimensional material is a pad for attenuating an impact force, such as from an opposing player during a sporting competition. The dimensional material is organic in shape, meaning that is it not of a standard geometric shape (e.g., circular, rectangular, or the like). The shape of the dimensional material, in this example, may provide specific functionality at specific locations relative to the base material 900. For example, the base material 900 may be a pattern portion to be integrated into a pair of athletic shorts and the dimensional material 1002 may a protective pad intended to protect a thigh and/or hip region of a wearer of the resulting garment. Therefore, to provide flexibility, ease of movement, and protection, the dimensional material 1002 may be oriented, shaped, and sized to achieve these features when integrated into the resulting garment.

It is contemplated that the dimensional material 1002 may be aligned on the base material 900 using a variety of techniques, such as an outline (e.g., outline stitch) or other indicators on the base material 900. Further, it is contemplated that the dimensional material 1002 may be secured, temporarily or permanently, to the base material 900 to maintain the desired alignment. The securing may be accomplished with an adhesive, bonding agent, mechanical fastener, welding, and the like, in an exemplary aspect.

Figure 11:
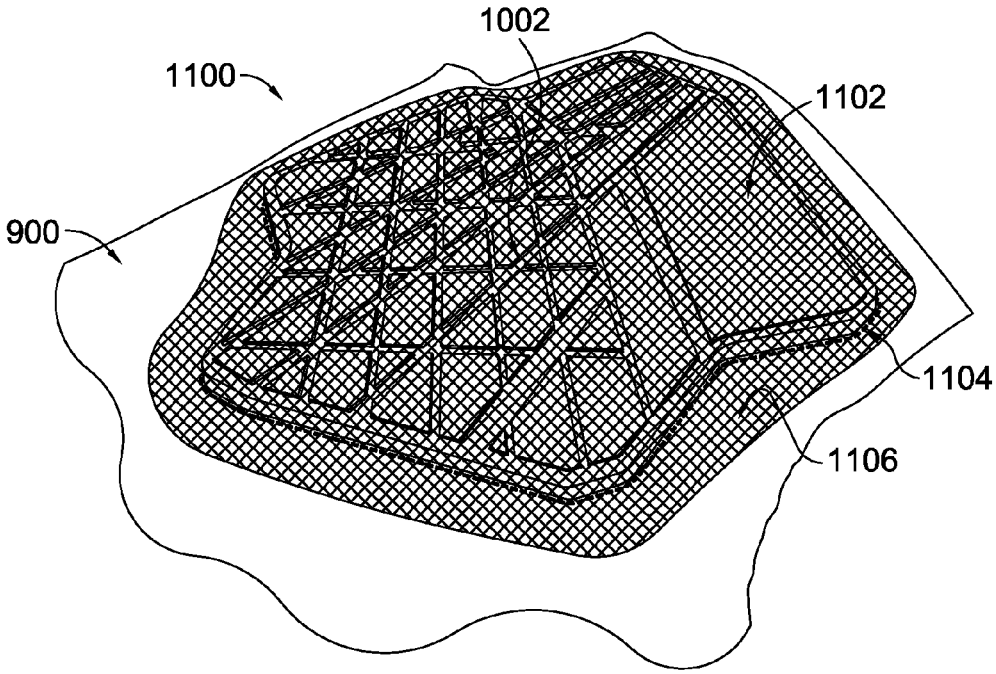
FIG. 11 depicts a composite piece formed from a base material, a dimensional material, and a top material, in accordance with aspects of the present invention.

FIG. 11 depicts a composite piece 1100 formed from the base material 900, the dimensional material 1002, and a top material 1102, in accordance with aspects of the present invention. Following the alignment and placement of the dimensional material 1002 as depicted in FIG. 10, the top material 1102 may be positioned atop the dimensional material 1002, as illustrated in FIG. 11.

The size and shape of the top material 1102 is such that it is at least a size and shape for securing a portion of the top material 1102 to a portion of the base material 900, in this example. The coupling of the top material 1102 with the base material 900 is depicted as a perimeter stitch 1104. The perimeter stitch 1104 extends along a bottom perimeter of the dimensional material 1002. The perimeter stitch 1104 encloses the dimensional material 1002 between the base material 900 and the top material 1102. In this example, a direct coupling (e.g., adhesive) between the dimensional material 1002 and the base material 900 may not be used as the formed pocket maintains the desired alignment of the portions.

Extending beyond the perimeter stitch 1104 are excess portions 1106 of the top material 1102. The excess portions 1106 may be removed at any point if desired. For example, it is contemplated that excess portions 1106 are trimmed following the sewing of the perimeter stitch 1104, which may be referred to as a basting stitch in an exemplary aspect. Following the trimming of the excess portion, a subsequent perimeter stitch (not shown) may be provided over or next to the perimeter stitch 1104. This secondary stitch may be implemented to attain a finished look to the recently trimmed top material 1102 and/or to impart additional strength to the coupling between the top material 1102 and the base material 900. This secondary stitch may be a 3 needle-5 thread cover stitch, in an exemplary aspect. However, it is contemplated that other stitching configurations may be implemented to achieve a similar result. Further, it is contemplated that the trimming of the excess portions 1106 may occur subsequent to the secondary perimeter stitch, in an exemplary aspect.

Figure 12:
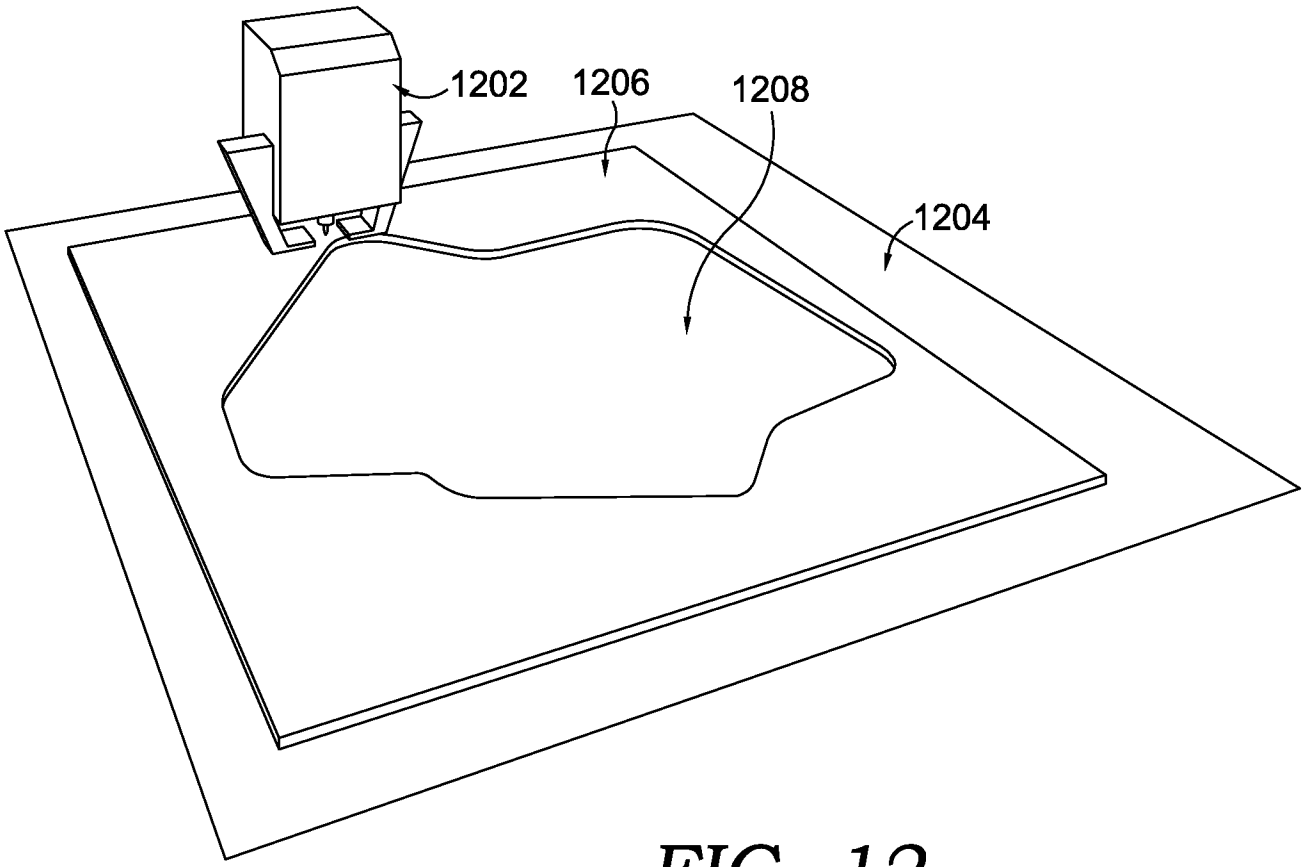
FIG. 12 depicts a custom embroidery frame positioned in a useable space of an embroidery head, in accordance with aspects of the present invention.

FIG. 12 depicts a custom embroidery frame 1206 positioned in a useable space 1204 of an embroidery head 1202, in accordance with aspects of the present invention. The frame 1206 is comprised of a receiving cavity 1208 sized and shaped to receive the composite piece 1100 discussed previously with respect to FIG. 11.

The position and alignment of the frame 1206 (and the related receiving cavity 1208) may be established using a number of techniques contemplated. For example, one or more indicators on the frame and one or more indicators associated with the embroidery head/embroidery device, and/or the useable space 1204 may be registered to align the frame 1206. Further, it is contemplated that a material, such as a punch sheet, may be positioned in the useable space 1204 and one or more defined patterns are run by the embroidery head 1202 to provide an indication as to where the frame (and/or the receiving cavity 1208) is to be positioned. For example, an outline like program may be processed by the embroidery head (and/or associated components) that results in an outline being embroidered into the underlying punch sheet that corresponds with the perimeter of the receiving cavity 1208. In this example, the receiving cavity 1208 may then be aligned with the embroidered outline in the underlying punch sheet. Further, it is contemplated that an internal volume of the punch sheet outline (or the entirety of the punch sheet) may then be removed to avoid interfering with subsequent embroidery operations.

Figure 13:
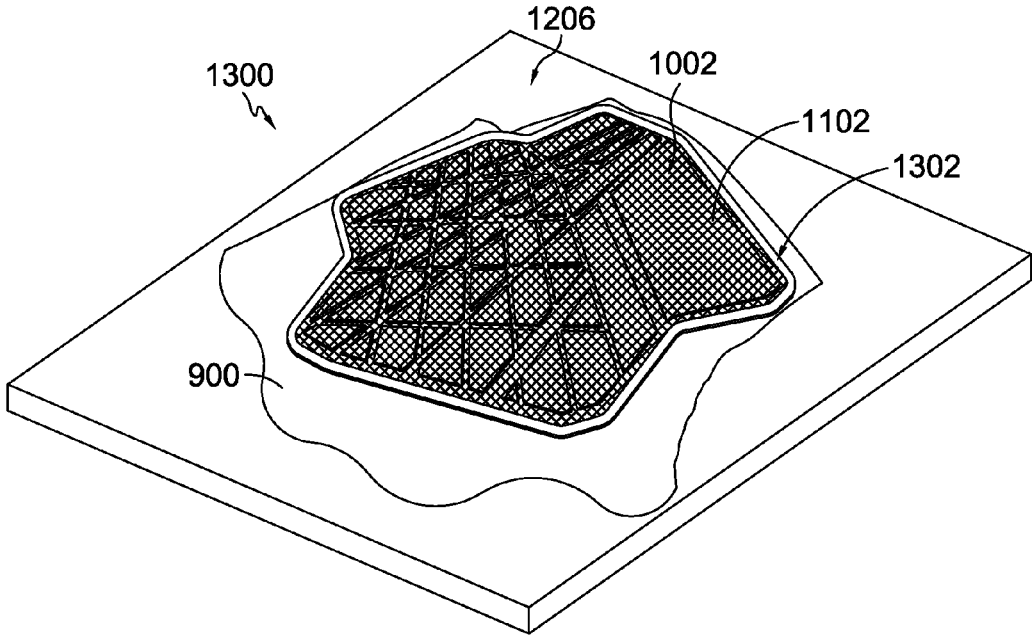
FIG. 13 depicts an embroidery system, in accordance with aspects of the present invention.

FIG. 13 depicts an embroidery system 1300, in accordance with aspects of the present invention. The embroidery system 1300 is comprised of the frame 1206, the base material 900, the dimensional material 1002, the top material 1102, and a gasket 1302. The base material 900, the dimensional material 1002, and the top material 1102 are collectively referred to as the composite piece. The composite piece is depicted as being inserted into the frame 1206. In an exemplary aspect it is contemplated that the composite piece as inserted into the frame 1206 is in a condition suitable to be embroidered by an embroidery device. However, additional aspects contemplate further utilizing the gasket 1302 in preparation for an embroidery process. As previously discussed, the gasket 1302 may provide additional tension, compression, and/or other forces to maintain the composite piece in a desired state (e.g., position, orientation, level of tension) for embroidery.

As depicted in FIG. 13, portions of the base material 900 extending away from the dimensional material 1002 extend beyond a receiving cavity into which the dimensional material 1002 is inserted. Therefore, it is contemplated that irrespective of the size of the base material, the frame 1206 is adapted and formed to maintain the portion of the composite piece to be embroidered, in an exemplary aspect.

Figure 14:
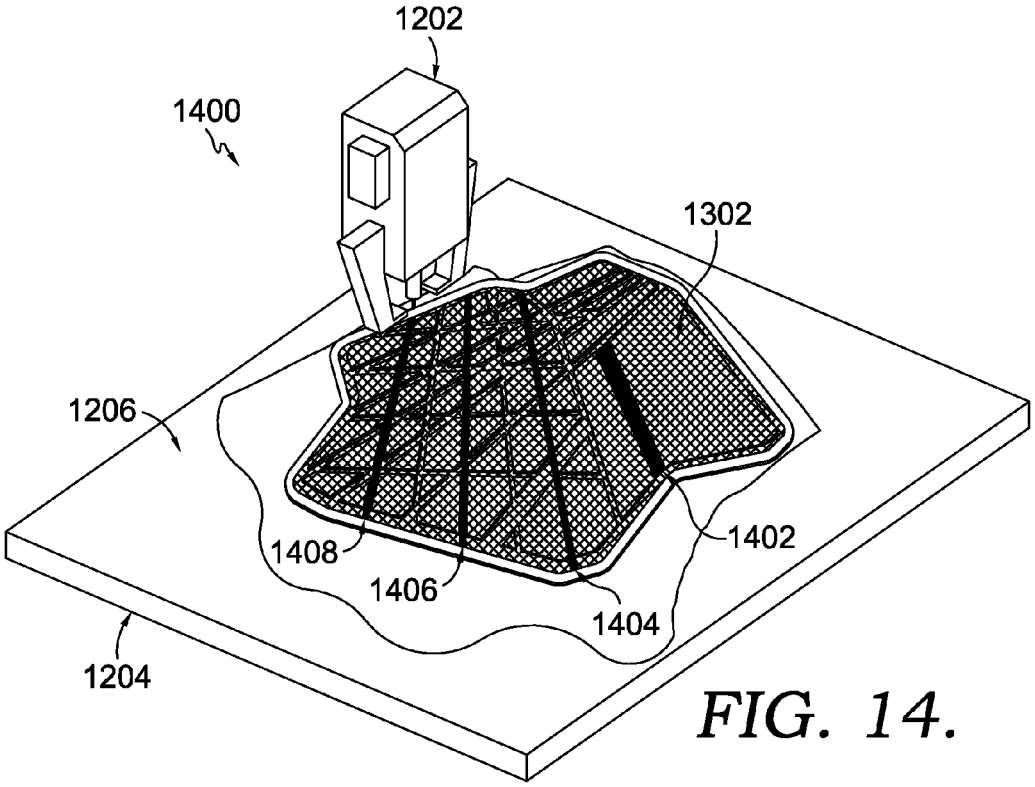
FIG. 14 depicts the embroidery system of FIG. 13 being embroidered by an embroidery head, in accordance with aspects of the present invention.

FIG. 14 depicts the embroidery system 1300 of FIG. 13 being embroidered by the embroidery head 1202, in accordance with aspects of the present invention. For example, embroidery lines 1402, 1404, 1406, and 1408 are exemplary embroidery that has been performed on the composite piece while being maintained in the frame 1206. It is contemplated that the embroidery may be performed at any location, in any shape, and at any size within portions of the composite piece. Therefore, while linear segments are depicted, it is understood that any embroidery shape may be implemented in exemplary aspects. In an exemplary aspect, the embroidery lines 1402-1408 are located within one or more grooves or openings of the dimensional material. For example, it is contemplated that the embroidery lines 1406 and 1408 are aligned with corresponding grooves in the underlying dimensional material. Further, it is contemplated that the embroidery line 1402 is aligned with a corresponding opening (e.g., void) in the underlying dimensional material. As can be appreciated, this alignment (and ability ensure alignment) of the embroidery with specific features of the composite piece 1302 exemplifies advantages able to be achieved with a custom embroidery frame system, as provided herein.

Figure 15:
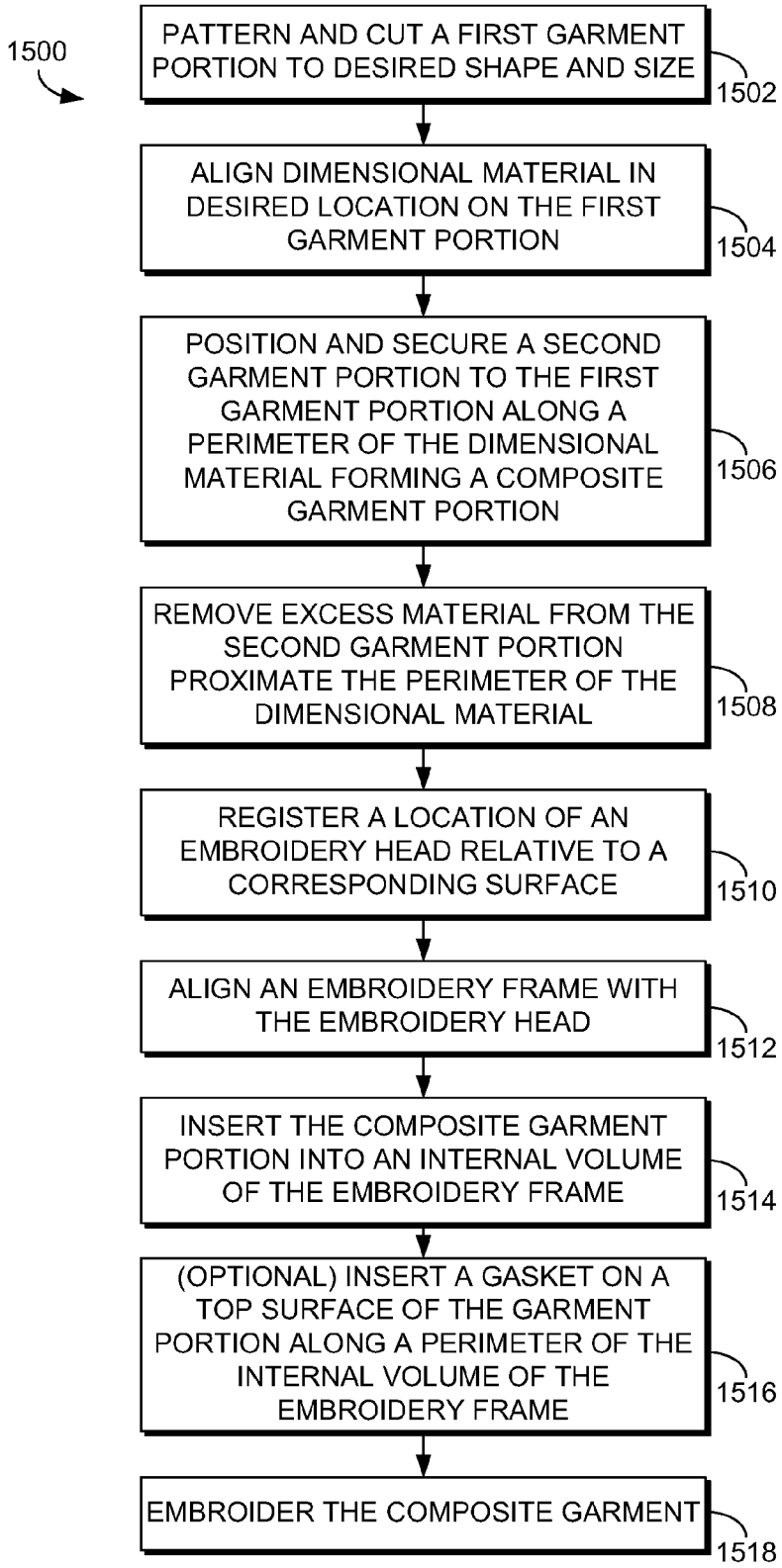
FIG. 15 depicts a block diagram illustrating an exemplary method for embroidering a composite piece utilizing a custom embroidery frame, in accordance with aspects of the present invention.

FIG. 15 depicts a block diagram illustrating an exemplary method 1500 for embroidering a composite piece utilizing a custom embroidery frame, in accordance with aspects of the present invention. At a block 1502, a material is patterned and cut to a desired shape and size as a first garment portion. As previously discussed, the patterning and cutting of a garment portion may include specifically shaping and sizing a portion of material such that that portion and other patterned portions may be assembled to result in an intended garment, such as a shirt, pants, shorts, socks, protective element, undergarment, shoe, and the like.

At a block 1504, a dimensional material is aligned in a desired orientation, position, and location on the first garment portion that was formed at the block 1502. The dimensional material may be a foam-like pad intended to provide impact attenuation when struck. The dimensional material has a defined shape and size when in an at-rest state, in an exemplary aspect. Further, the dimensional material may have a resistance to deformation such that when inserted into a custom embroidery frame, a compressive force is generated that maintains the first garment portion in a desired position relative to the frame.

At a block 1506, a second garment portion is positioned and secured to the first garment portion along a perimeter of the dimensional material. The securing, such as by stitching, of the second garment portion to the first garment portion with the dimensional material captured between the garment portions results in a composite piece (or a composite garment portion). As previously discussed, it is contemplated that a basting stitch is used to at least temporarily maintain the portions of the composite piece in desired locations. It is contemplated that a second, reinforcing, stitch may then be applied along the perimeter, such as a 3 needle-5 thread cover stitch. However, additional reinforcing stitches are contemplated.

At a block 1508, excess material from the second garment portion (e.g., a top material) may be removed proximate the perimeter of the dimensional material. Stated differently, it is contemplated that any excess material extending beyond a coupling mechanism (e.g., basting stitch) between the first and the second garment portion may be removed.

At a block 1510, a location of an embroidery head is registered relative to an underlying useable surface. The registration may be performed in a number of manners, such as by placing a punch sheet (e.g., disposable material) in the useable area and running a desired embroidery pattern into the punch sheet to identify the alignment of the embroidery head relative to the corresponding useable space. Other registrations may include mechanical indicators (e.g., alignment grids), optical indicators (e.g., laser position indicators), and the like.

At a block 1512, an embroidery frame is aligned with the embroidery head. The alignment of the embroidery frame may, in an exemplary aspect, be based on the registration process discussed at the block 1512. For example, the embroidery frame may be comprised of a receiving cavity that extends through a top surface and a bottom surface of the embroidery frame. Therefore, the registration provided by an embroidered punch sheet may be visible through the receiving cavity to aid in aligning the embroidery frame with the embroidery head.

At a block 1514, the composite garment portion is inserted into an internal volume, such as a receiving cavity, of the embroidery frame. The insertion may be accomplished such that a bottom surface of the composite garment portion is inserted first into a receiving cavity beginning at the top surface of the embroidery frame. This is a top loading configuration, which allows the embroidery frame to be maintained in an aligned position through multiple embroidery processes of multiple composite garment portions.

At a block 1516, a gasket is inserted on a top surface of the composite garment portion along a perimeter of the internal volume of the embroidery frame. Therefore, the gasket is positioned between the dimensional material and the embroidery frame with one or more portions of the first and/or second garment portions also positioned thereto. It is contemplated that the gasket and its utilization may be omitted in an exemplary aspect. For example, where the composite garment portion provides sufficient forces against the embroidery frame to maintain a desired position and allow for successful embroidery, the gasket may be omitted, in an exemplary aspect. As a result, the phrase "(OPTIONAL)" is included with the block 1516 to highlight that the utilization of a gasket (and related steps(s)) may be omitted in exemplary aspects. While the block 1516 explicitly indicates the word "optional," it is understood that one or more other blocks/steps of the method 1500 may also be optional in exemplary aspects even though the term "optional" is not explicitly recited therewith. A similar "(optional)" marking strategy is implemented in FIGS. 16 and 19 hereinafter.

At a block 1518, the composite garment portion is embroidered by an embroidery device. The embroidery may include coupling, directly or indirectly, all of the portions of the composite garment portion.

Figure 16:
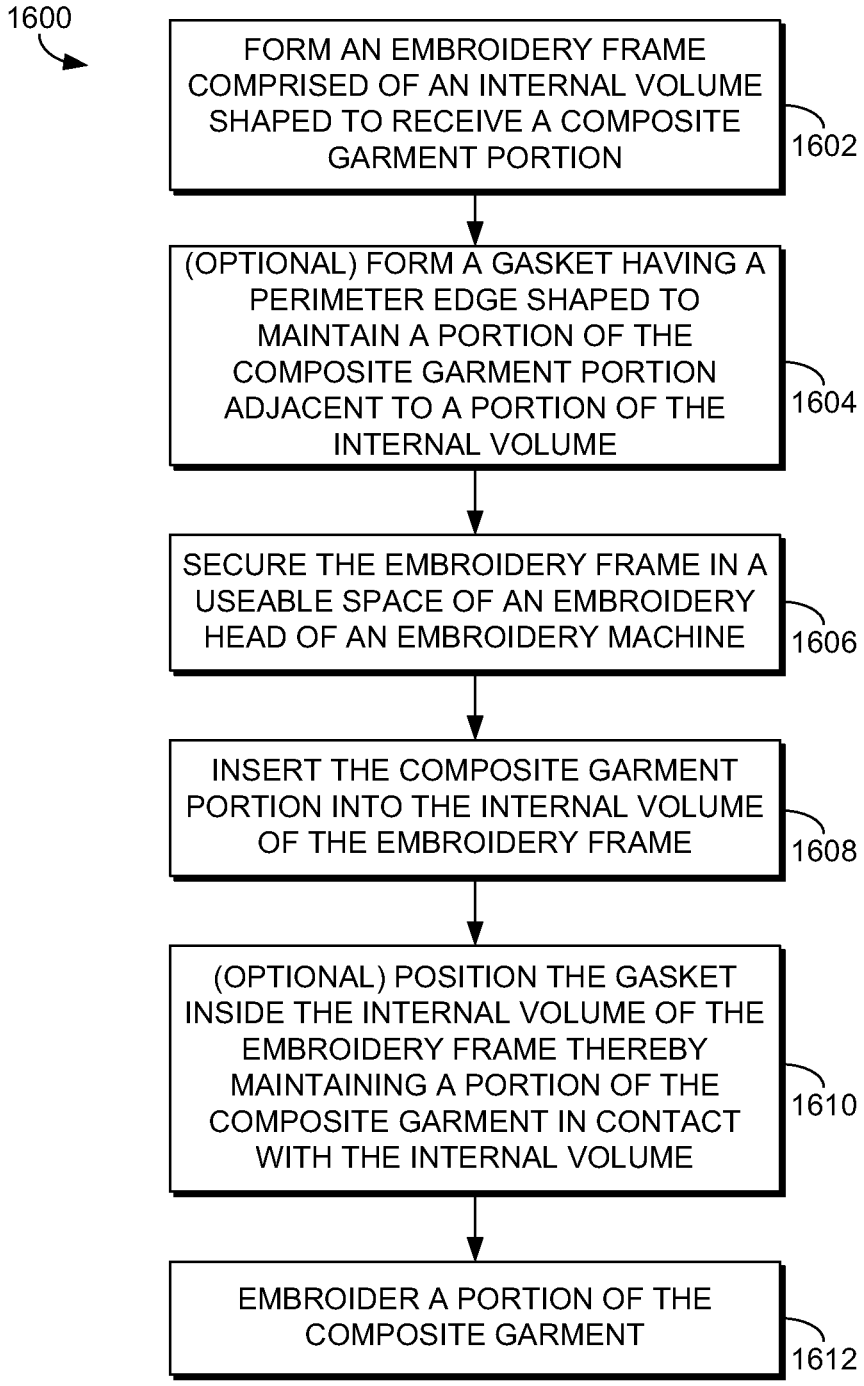
FIG. 16 depicts a block diagram illustrating a method for utilizing a custom embroidery system, in accordance with aspects of the present invention.

FIG. 16 depicts a block diagram illustrating a method 1600 for utilizing a custom embroidery system, in accordance with aspects of the present invention. At a block 1602, an embroidery frame is formed. For example, a CNC device, such as a laser, a mechanical cutter, a milling machine, an additive manufacturing machine, or the like may convert a digital file (e.g., a CAD file) describing a custom embroidery frame into a tangible object. For example, it is contemplated that a foam board is cut with a CNC laser to result in a receiving cavity (e.g., internal volume) having a size and a shape corresponding to a composite piece to be inserted therein.

At a block 1604, a gasket is formed having a perimeter edge shaped to maintain a portion of the composite garment portion adjacent to a portion of the internal volume. As previously discussed, the gasket may be formed from a variety of materials and from a variety of techniques. For example, it is contemplated that a rapid manufacturing material (e.g., sintered powder) may be formed in a manner that results in an appropriate gasket that is sized and shaped to be received in the internal value and around the composite garment portion, in an exemplary aspect.

At a block 1606, the embroidery frame is secured in a useable space of an embroidery head of an embroidery machine/device. As previously discussed, the securing of the frame may be accomplished with temporary fasteners (e.g., magnetic attraction, tape), mechanical fasteners (e.g. clips), and other methods. In addition to securing, the embroidery frame (or more particularly, the internal volume) may be aligned in a defined spot, such as through one or more registration techniques provided herein.

At a block 1608, a composite garment portion (e.g., composite piece) is inserted into the internal volume of the embroidery frame. For example, a top loading process may be implemented, as previously discussed. Once inserted, it is contemplated that portions of the composite garment portion are placed in a state of tension such that an embroidery process may be implemented. Additionally, it is contemplated that one or more portions of the composite garment portion (e.g., a base material) returns back out of the internal void to a top surface of the frame. The return of the material allows for a top loading of material without affecting the alignment and maintaining of the composite garment portion when excess material would otherwise consume volume of the internal volume.

At a block 1610, the gasket is positioned inside the internal volume of the embroidery frame thereby maintaining a portion of the composite garment in contact with the internal volume. As previously discussed, the utilization of a gasket may be omitted entirely in exemplary aspects. At a block 1612, a portion of the composite garment is embroidered by the embroidery device while being maintained by the embroidery frame.

Figure 17:
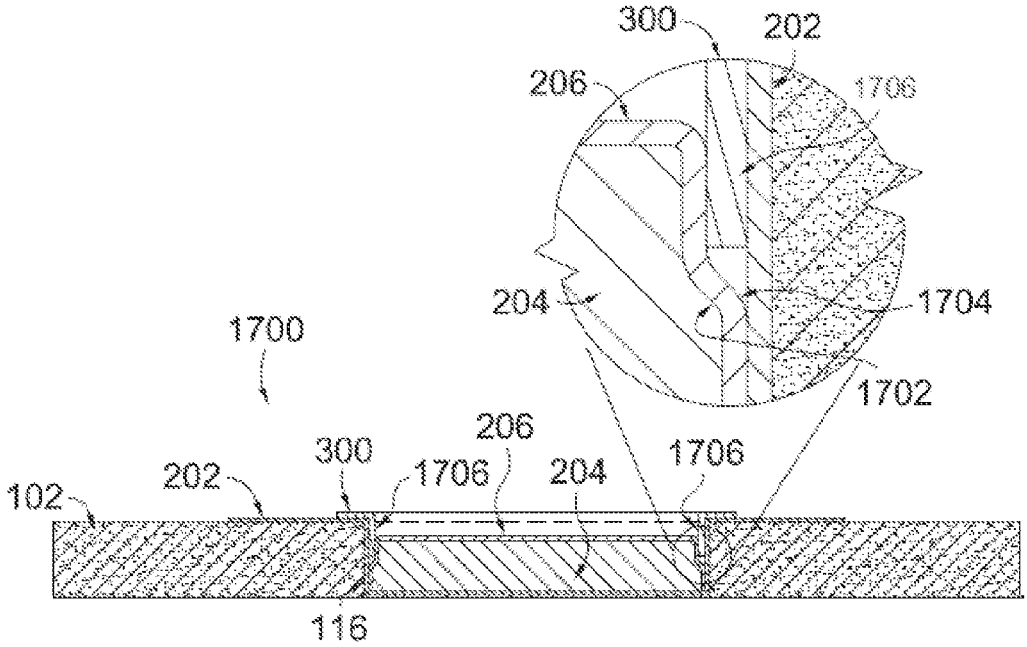
FIG. 17 depicts a cross-sectional view similar to that of FIG. 3 with an alternative top material and gasket configuration, in accordance with aspects of the present invention.

FIG. 17 depicts a cross-sectional view of an embroidery system 1700 similar to that of FIG. 3 with an alternative top material 206 and gasket 300 configuration, in accordance with aspects of the present invention. In this example, the top material 206 terminates proximate a bottom perimeter of the dimensional material 204. For example, as previously discussed, it is contemplated that the top material 206 is trimmed/cut to remove excess material extending away from a perimeter stitch.

Additionally, FIG. 17 depicts an insertion flange 1706 of the gasket 300 extending partially into the receiving cavity between the inner sidewall 116 (that is lined with the base material 202) and the dimensional material 204 (that is lined with the top material 206). As a result of the insertion of the gasket 300, an additional compressive force is generated that results in a tensioning of one or more portions of the composite piece. For example, as depicted in the exploded portion of FIG. 17, a deformation 1702 of the dimensional material 204 occurs as the insertion flange 1706 fills volume within the receiving cavity, in an exemplary aspect. While not depicted, it is also contemplated that the frame 102 may compress or otherwise deform upon the insertion of the gasket 300. In an exemplary aspect, it is the resilience of the frame and the ability of the frame to deform in response to the insertion of an object imparts an ability of the custom embroidery frame to maintain the composite piece in an effective manner for embroidery to occur. Therefore, the composite piece, the frame 102, and/or the combination may deform (e.g., compress) upon the insertion of the gasket 300 into the receiving cavity. This deformation of one or more portions of the embroidery system may generate a void 1704, depending on the material from which the frame 102 and/or portions of the composite piece are formed.

Figure 18:
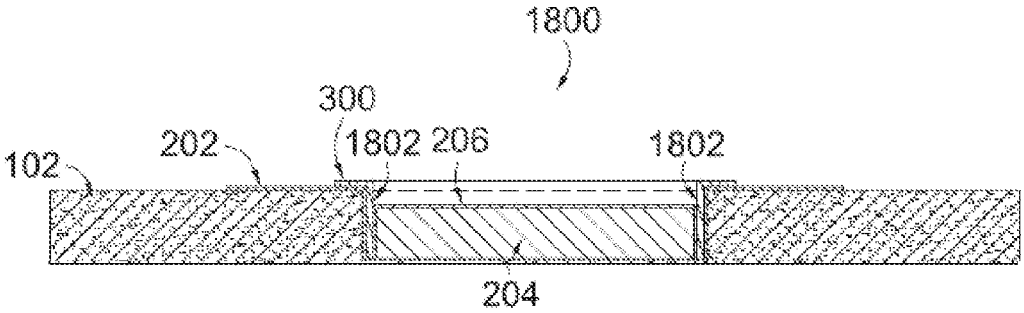
FIG. 18 depicts a cross-sectional view similar to that of FIG. 17 with an alternative gasket configuration, in accordance with aspects of the present invention.

FIG. 18 depicts a cross-sectional view of an embroidery system 1800 similar to that of FIG. 17 with an alternative gasket 300 configuration, in accordance with aspects of the present invention. In particular, the gasket 300 is comprised of an insertion flange 1802 having a length equal to or greater than an approximate height of a composite piece to be inserted into a receiving cavity. As a result, the insertion flange 1802 extends to a position proximate a lower perimeter of the dimensional material 204 when the composite piece is inserted into the receiving cavity. It is contemplated that one or more of the composite piece and/or the frame 102 deform to accept the insertion flange 1802 portion of the gasket 300.

It is contemplated that alternative portions of a gasket, a composite piece, and/or a frame may be implemented to achieve benefits of the custom embroidery system provided herein. For example, insertion flange length and sizes may be altered to adjust a level of tension provided, compression introduced, and position of contact. Similarly, it is contemplated that one or more portions of the composite piece may terminate within the receiving cavity or extend outwardly from the receiving cavity (e.g., the top material).

Figure 19:
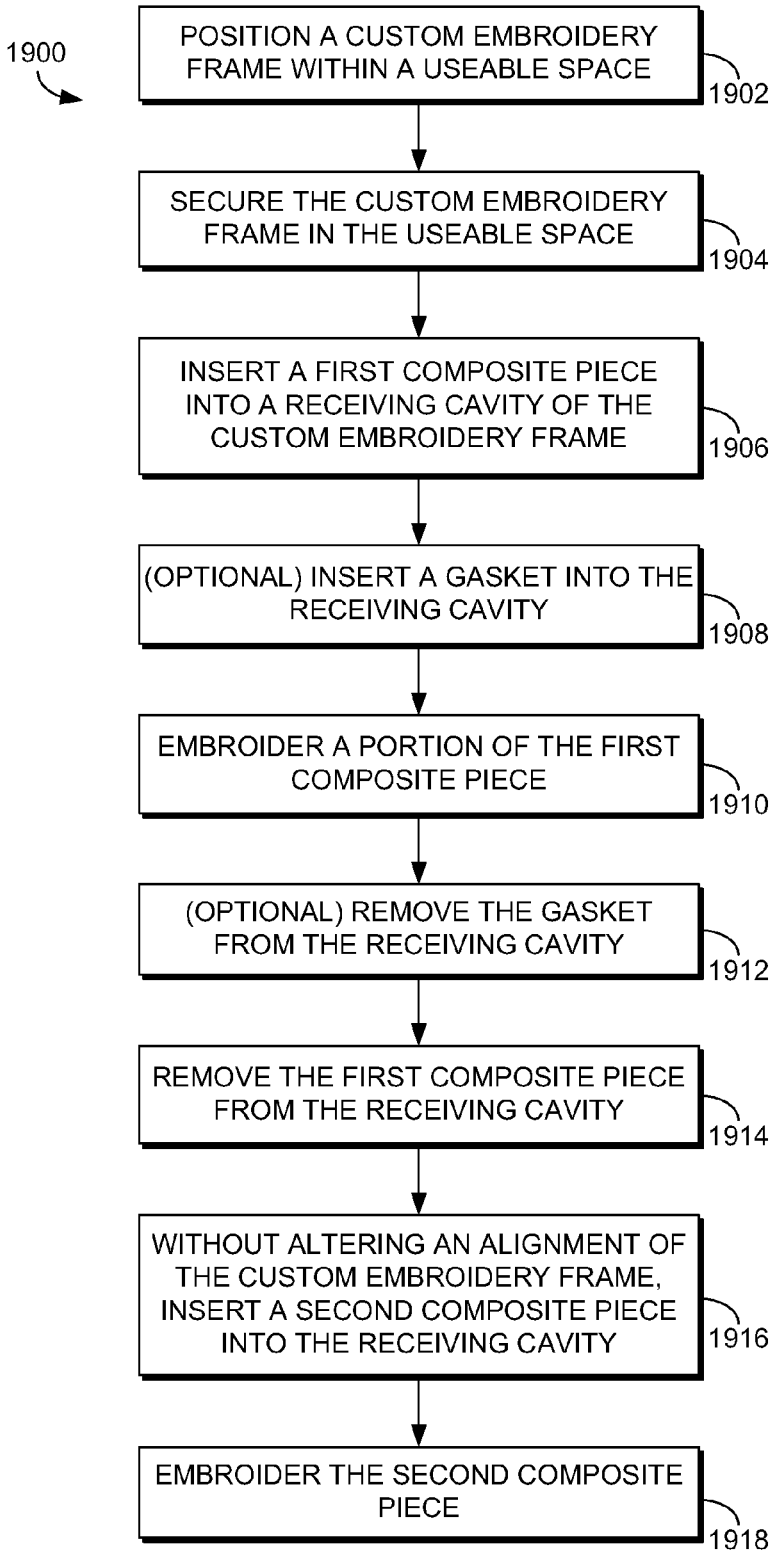
FIG. 19 depicts a block diagram illustrating a method for utilizing a custom embroidery system, in accordance with aspects of the present invention.

FIG. 19 depicts a block diagram illustrating a method 1900 for utilizing a custom embroidery system, in accordance with aspects of the present invention. At a block 1902, a custom embroidery frame is positioned within a useable space of an embroidery device. The positioning may include placing the embroidery frame at a defined location. For example, it is contemplated that an alignment step is performed prior to positioning the embroidery frame.

An alignment step, as previously discussed, may include attaching a material, such as a punch sheet, to a portion of the useable space. The material, in this example may be sacrificial in that once it has been embroidered with a predefined pattern; the material may be removed after positioning the embroidery frame. For example, it is contemplated that the material is secured to the useable place and a predefined pattern is embroidered by the embroidery device. The predefined pattern may include one or more alignment markers that are useable for aligning the embroidery frame. Following the embroidering of the pattern, the frame may be positioned in the useable space on top of the material and in alignment with the embroidered pattern. So long as the embroidery frame is not moved or re-positioned during the insertion and removal of composite pieces, it is contemplated that this alignment step and positioning of the embroidery frame may be omitted prior to embroidering subsequent composite pieces. Stated differently, the embroidery frame does not need to be positioned prior to each embroidery operation on successive composite pieces after an initial positioning.

At a block 1904, the custom embroidery frame is secured in the useable space. As previously discussed, the embroidery frame may be secured with a number of methods. For example, a clamp, clip, adhesive, welding, fastener (e.g., bolt, pin, screw), and the like. The frame is secured in an aligned positioned, in an exemplary aspect. Once secured, the embroidery frame is not moved until a final composite piece in a manufacturing run for which the frame is adapted is embroidered, in an exemplary aspect.

At a block 1906, a first composite piece is inserted into a receiving cavity of the custom embroidery frame. As previously discussed, the insertion may be from the top down as a result of the securement of the frame to the useable space, which may prevent a bottom insertion.

At a block 1908, a gasket is inserted into the receiving cavity. As previously discussed, it is contemplated that the utilization of a gasket may be omitted in exemplary aspects. Further, as previously discussed with respect to FIGS. 3, 17, and 18, the gasket may be inserted in a variety of manners relative to the frame and the composite piece.

At a block 1910, a portion of the first composite piece is embroidered. Embroidering may include a user instructing an embroidery device to embroider. Further, it is contemplated that a computing device instructs an embroidering device to embroider one or more portions.

At a block 1912, the gasket is removed, in this exemplary aspect. At a block 1914, the first composite piece is also removed from the receiving cavity. In an exemplary aspect, the first composite piece is removed from the top side of the frame, which allows the frame to remain in a desired position of the useable space. As a result, the removal of the first composite piece does not affect the position and alignment of the embroidery frame, which allows a second composite piece to be inserted into the receiving cavity for embroidery without requiring re-alignment/re-positioning of the embroidery frame, as depicted at a block 1916. As previously discussed, the ability to forego positioning the frame on subsequent composite pieces in a manufacturing run of common composite pieces provide efficiencies not afforded by traditional maintaining mechanism that are removed from the useable space to unload an embroidered article.

At a block 1918, the second composite piece is embroidered as it is maintained in the custom embroidery frame. As previously discussed, it is contemplated in an exemplary aspect that the second composite piece is inserted into and embroidered in the custom embroidery frame without repositioning the embroidery frame between the first and second composite piece embroidery operations.

While specific steps are discussed with respect to methods provided herein, it is contemplate that one or more steps may be omitted or reordered in light of the foregoing. Although the custom embroidery system is described above by referring to particular embodiments, it should be understood that the modifications and variations could be made to the system described without departing from the intended scope of protection provided by the following claims. For example, it is contemplated that a custom maintaining frame may be implemented in other manufacturing processes other than embroidery. For example, printing, cutting, general sewing, forming, and other manufacturing technique may implement one or more portions of the systems provided herein.

The invention claimed is:

1. A custom embroidery frame in combination with a composite piece to be embroidered, the frame comprising:

a top surface and an opposite bottom surface, the top surface and bottom surface defining a frame thickness extending from the top surface to the bottom surface, wherein the top surface is positionable in a plane closer to an embroidery head of an embroidery device than the bottom surface;

a receiving cavity extending from the top surface to the bottom surface, the receiving cavity defined by a top perimeter of a shape and a size at the top surface; and the top perimeter shape and size substantially corresponding to a shape and a size of the composite piece to be embroidered, such that the receiving cavity receives and maintains the composite piece during an embroidery process, wherein the composite piece to be embroidered is comprised of a base material portion, a dimensional padded material positioned between the base material and a top material portion, wherein an upper edge perimeter of the dimensional padded material defines the shape and size of the composite piece to be embroidered.

2. The custom embroidery frame of claim 1, wherein the embroidery frame is constructed from a foam-based material, a polymer-based material, a metal material, or an organic material.

3. The custom embroidery frame of claim 1, wherein the embroidery frame is constructed from an elastic deformable material functional to apply a compressive force on the composite piece within the receiving cavity.

4. The custom embroidery frame of claim 1, wherein the receiving cavity extends through the bottom surface.

5. The custom embroidery frame of claim 1, wherein the composite piece is zero to five percent less the size of the perimeter.

6. The custom embroidery frame of claim 1, wherein the composite piece is zero to one percent less the size of the perimeter.

7. The custom embroidery frame of claim 1, wherein the receiving cavity is further defined by a bottom perimeter, the bottom perimeter is bigger than the top perimeter.

8. The custom embroidery frame of claim 1 further comprising a gasket, the gasket having an insertion flange, the insertion flange comprised of an interior surface and an opposite exterior surface.

9. The custom embroidery frame of claim 8, wherein the insertion flange has a shape and a size substantially corresponding to the receiving cavity top perimeter.

10. The custom embroidery frame of claim 8, wherein the top perimeter has a size at least that of the insertion flange.

11. A method of embroidering using a custom embroidery frame, the method comprising:

forming an embroidery frame comprised of a receiving cavity extending from a top surface of the embroidery frame to a bottom surface of the embroidery frame such that an internal sidewall extends between the top surface and the bottom surface, wherein a shape and a size of the receiving cavity in a plane of the top surface is defined by a top perimeter, the top perimeter having a shape and a size substantially corresponding to a shape and a size of a composite piece;

inserting the composite piece, with a top face and a bottom face, in the receiving cavity from the top surface towards the bottom surface such that the top face of the composite piece is flush from the top surface, wherein the composite piece is comprised of (1) a first garment portion having an upper surface and a lower surface and (2) a dimensional material having an upper surface, a lower surface, and a side wall extending between the upper surface and the lower surface along a perimeter of the dimensional material;

at least a portion of the lower surface of the first garment portion is positioned proximate the internal side wall of the receiving cavity and at least a portion of the upper surface of the first garment portion is positioned proximate the side wall of the dimensional material, such that at least a portion of the first garment portion is positioned between the embroidery frame and the dimensional material; and embroidering with an embroidery device the composite material within the receiving cavity.

12. The method of claim 11, wherein the embroidery frame is formed from a polymer-based material, a foam-based material, or an organic-based material, and the dimensional material is comprised of an impact-attenuating material.

13. The method of claim 11, wherein the forming of the embroidery frame is one of a subtractive process or an additive process.

14. The method of claim 11 further comprising cutting the first garment portion to a patterned size and shape prior to inserting the composite material in the receiving cavity.

15. The method of claim 11 further comprising aligning the dimensional material in a desired location on the first garment portion prior to inserting the composite material in the receiving cavity.

16. The method of claim 11 further comprising, prior to inserting the composite material in the receiving cavity, securing a second garment portion to the first garment portion along a perimeter substantially defined by a perimeter of the dimensional material.

17. The method of claim 16 further comprising removing a portion of the second garment portion, wherein the portion removed from the second garment portion extends from an edge of the second garment portion substantially to the perimeter at which the second garment portion is secured to the first garment portion.

18. The method of claim 11 further comprising identifying a location in a useable space of the embroidery device to which the embroidery frame should be positioned.

19. The method of claim 18 further comprising securing the embroidery frame in the useable space of the embroidery device at the identified position.

20. The method of claim 11 further comprising forming an embroidery gasket, the embroidery gasket comprised of an insertion flange, the insertion flange having a size and a shape substantially corresponding with the embroidery frame top perimeter.

21. The method of claim 20 further comprising inserting the embroidery gasket such that a portion of the first garment portion is positioned between the insertion flange and the internal sidewall of the embroidery frame.

22. The method of claim 11 further comprising removing the composite material subsequent to embroidering, wherein the composite material is removed from the top surface of the embroidery frame without adjusting a position of the embroidery frame relative to the embroidery device.

23. An embroidering system comprising:

a composite material, the composite material comprised of:

(1) a base material portion having a bottom surface and an intermediate surface, the base material portion shaped in a pattern form for integration into a garment, (2) a dimensional padded material, the dimensional padded material having an upper surface and an opposite lower surface, an upper edge perimeter and a lower edge perimeter, and a side wall extending between the upper edge perimeter and the lower edge perimeter, wherein the upper edge perimeter defines a shape and a size of the dimensional padded material, (3) a top material portion having an intermediate surface and an opposite top surface, and (4) the dimensional padded material positioned between the base material intermediate surface and the top material portion intermediate surface, wherein the base material intermediate surface and the top material portion intermediate surface are coupled together proximate at least a portion of one of the lower edge perimeter or the upper edge perimeter of the dimensional padded material; and a custom embroidery frame, the custom embroidery frame comprised of:

(1) a base material having a top surface and a bottom surface, (2) a receiving cavity extending between the base material top surface and the base material bottom surface, wherein the receiving cavity has a perimeter at the top surface defining a size and a shape in a plane of the top surface of the receiving cavity, and (3) the size and the shape of the receiving cavity perimeter substantially corresponds to the upper edge perimeter of the dimensional padded material, such that the receiving cavity is functional for receiving the composite material and maintaining the composite material during an embroidery process.

24. The embroidering system of claim 23, wherein the custom embroidery frame further comprises an embroidery gasket, the embroidery gasket having an insertion flange shaped and sized to compress at least a portion of the base material against at least a portion of an interior sidewall of the receiving cavity.

25. A method of embroidering using a custom embroidery frame, the method comprising:

positioning the custom embroidery frame within a useable space of an embroidery device;

inserting a first composite piece into a receiving cavity of the custom embroidery frame, wherein the first composite piece is comprised of a first base material portion, a first dimensional padded material positioned between the first base material and a first top material portion, wherein a first upper edge perimeter of the first dimensional padded material defines the shape and size of the first composite piece and the shape and size of the receiving cavity of the custom embroidery frame;

embroidering a portion of the first composite piece;

removing the first composite piece from the receiving cavity;

prior to moving the custom embroidery frame from the useable space and subsequent to removing the first composite piece, inserting a second composite piece into the receiving cavity, wherein the second composite piece is comprised of a second base material portion, a second dimensional padded material positioned between the second base material and a second top material portion, wherein the second composite piece has the same shape and size of the first composite piece; and embroidering a portion of the second composite piece.

26. The method of claim 25 further comprising, prior to positioning the custom embroidery frame, identifying a location in the useable space at which the embroidery frame is to be positioned.

27. The method of claim 26, wherein identifying the location is comprised of embroidering, with the embroidery device, a predetermined pattern, the predetermined pattern providing one or more indications of the location in the useable space.

28. The method of claim 25 further comprised of inserting a gasket into the custom embroidery frame.

* * * * *